US006585187B2

(12) United States Patent
Miyaguchi et al.

(10) Patent No.: US 6,585,187 B2
(45) Date of Patent: Jul. 1, 2003

(54) BAND PLATE WINDING SYSTEM

(75) Inventors: Kanehisa Miyaguchi, Hiroshima (JP); Nobuhiro Shibatomi, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/144,799

(22) Filed: May 15, 2002

(65) Prior Publication Data

US 2002/0130213 A1 Sep. 19, 2002

Related U.S. Application Data

(62) Division of application No. 09/297,936, filed as application No. PCT/JP98/05309 on Nov. 26, 1998.

(30) Foreign Application Priority Data

| | | |
|---|---|---|
| Nov. 27, 1997 | (JP) | 9-325678 |
| Dec. 26, 1997 | (JP) | 9-359139 |
| Jan. 14, 1998 | (JP) | 10-5315 |
| Jan. 29, 1998 | (JP) | 10-16510 |
| Apr. 20, 1998 | (JP) | 10-109002 |
| Jul. 6, 1998 | (JP) | 10-190781 |

(51) Int. Cl.[7] ..... B65H 19/22; B65H 18/26

(52) U.S. Cl. ..... 242/533.5; 242/533.6; 242/542.2

(58) Field of Search ..... 242/533.4, 533.5, 242/533.6, 532, 541.1, 542.2, 531.1, 532.7, 532.5, 548.3; 92/80, 82

(56) References Cited

U.S. PATENT DOCUMENTS

| | | | | |
|---|---|---|---|---|
| 2,526,010 A | | 10/1950 | Edstrom | |
| 2,725,104 A | | 11/1955 | Wood | |
| 3,100,605 A | | 8/1963 | Bond | |
| 3,913,367 A | | 10/1975 | Galletti | |
| 4,004,747 A | | 1/1977 | Schulze | |
| 4,964,587 A | | 10/1990 | Oki et al. | |
| 5,007,327 A | | 4/1991 | Kamimura et al. | |
| 5,035,373 A | | 7/1991 | Perrigo | |
| 5,190,232 A | | 3/1993 | Brandon et al. | |
| 5,660,351 A | | 8/1997 | Osanai | |
| 5,746,335 A | | 5/1998 | Brough et al. | |
| 5,904,313 A | | 5/1999 | Perret et al. | |
| 5,927,523 A | | 7/1999 | Huggins et al. | |
| 5,967,448 A | | 10/1999 | Berry et al. | |
| 6,065,713 A | | 5/2000 | Perenon | |
| 6,283,403 B1 | | 9/2001 | Braun et al. | |
| 6,332,588 B1 | * | 12/2001 | Drigani et al. | 242/533.4 |
| 6,364,242 B1 | * | 4/2002 | Braun et al. | 242/532 |
| 6,371,400 B1 | * | 4/2002 | Morimoto et al. | 242/532.2 |

FOREIGN PATENT DOCUMENTS

| | | |
|---|---|---|
| EP | 294480 | 12/1988 |
| EP | 0897765 A1 | 2/1999 |
| GB | 867086 | 5/1961 |
| GB | 2327414 | 1/1999 |
| JP | 58167021 A | 10/1983 |
| JP | 1005626 A | 1/1989 |
| JP | 404084620 | 3/1992 |
| JP | 405038519 | 2/1993 |
| JP | 405057344 | 3/1993 |
| JP | 406190442 | 7/1994 |
| WO | 96/30137 | 10/1996 |

* cited by examiner

*Primary Examiner*—Kathy Matecki
*Assistant Examiner*—Minh-Chau Pham
(74) *Attorney, Agent, or Firm*—Birch, Stewart, Kolasch, & Birch, LLP.

(57) ABSTRACT

The structure disclosed aims to provide a band plate winding system capable of high speed winding at a low cost. The band plate winding system comprises a carrousel type winder having a plurality of individually driven mandrels on a circular support frame provided so as to be rotationally drivable in a vertical plane, and a roll type wrapping device for supporting a plurality of unit rolls each provided so as to be moveable forward and backward between a position surrounding the mandrel located at a winding start position of the winder and a retreat position.

22 Claims, 32 Drawing Sheets

BAND PLATE WINDING SYSTEM

This application is a divisional of co-pending Application No. 09/297/936, filed on Jul. 8, 1999 and for which priority is claimed under 35 U.S.C. § 120. Application No. 09/297,936 is the national phase of PCT International Application No. PCT/JP98/05309 filed on Nov. 26, 1998 under 35 U.S.C. § 371. The entire contents if each of the above-identified applications are hereby incorporated by reference. This application also claims priority of Application Nos 9-325678, 9-359139, 10-5315, 10-16510, 10-109002 and 10-190781, filed in Japan on Nov. 27, 1997, Dec. 26, 1997, Jan. 14, 1998, Jan. 29, 1998, Apr. 20, 1998, and Jul. 6, 1998, respectively under 35 U.S.C. § 119.

TECHNICAL FIELD

This invention relates to a band plate winding system in rolling equipment.

BACKGROUND ART

On a line delivery side of hot rolling equipment or the like, a down coiler or carrousel type (double-drum type) winder is generally disposed as a band plate winding system for continuously winding a rolled band plate.

A conventional band plate winding system using a down coiler is shown, for example, in FIG. 36.

As illustrated, a roller table 600 is placed on a rolling equipment line, and a pinch roll (or a deflector roll) 601 is placed near a delivery side of the rolling equipment line. A band plate 602 that has been rolled is guided to mandrels (winding drums) 603 of a plurality of down coilers placed at spaced apart locations on the delivery side of the rolling equipment line.

Around each mandrel 603, plural pairs (3 pairs in the drawing) of arm-shaped frames 604*a*, 604*b*, 604*c* are each provided so as to be supported at one end on a fixing base 605 via a shaft 606. Each frame is pivotable such that its front end is brought toward or away from each mandrel 603 from three directions.

On the pairs of frames 604*a*, 604*b*, 604*c*, unit rolls 607 are supported so as to come into contact with the mandrel 603, and presser plates 608 are also supported integrally to face an outer surface of the mandrel 603. To these frames 604*a*, 604*b*, 604*c*, driving cylinders 609 are connected for driving the frames 604*a*, 604*b*, 604*c* so as to be brought toward or away from the outer surface of the mandrel 603.

Thus, the rolled band plate 602 is moved from the pinch roll 601 along a guide (not shown), and its front end is guided to one of the mandrels 603. Then, with the band plate 602 being pressed against the outer surface of the mandrel 603 by the three unit rolls 607 upon driving by the driving cylinders 609, the mandrel 603 is rotationally driven in a winding direction. In this manner, winding of the band plate 602 is performed.

After a predetermined length of the band plate 602 is taken up, the band plate 602 is cut with a cutter (not shown) disposed on the line. A front end of the remaining band plate 602 is guided from the other pinch roll 601 to the other mandrel 603, and the band plate 602 is similarly wound. During this period, a coil of the band plate 602 is removed from the outer surface of the mandrel 603, which has finished winding, onto a carrier trolley or the like. In this manner, winding into a coil is continued.

A conventional band plate winding system using a carrousel type winder is exemplified in FIG. 37.

As illustrated therein, a circular support frame 610 is installed at a delivery-side side portion of a rolling equipment line so as to be rotationally driven in a vertical plane. At symmetrical positions of the support frame 610, a plurality of mandrels 611 are supported horizontally via bearings. The drawing shows a case in which there are two mandrels 611.

The support frame 610 is turned, as necessary, by an inherent driving system. The mandrels 611 on the support frame 610 are driven in a winding or unwinding manner by individual driving systems when a band plate is wound into or unwound from a coil C.

At the rolling equipment line side on the support frame 610, a wrapping device 612 for a band plate 602 is provided which moves so as to surround or expose the mandrel 611.

The wrapping device 612 is composed of a pair of arm-shaped frames 614 and a pair of arm-shaped frames 615 having one end rotatably mounted on a fixing base 613 via shafts and spreading around the mandrel 611, a belt or chain member 617 passed in an endless form over four guide rolls 616 supported on the pairs of arm-shaped frames 614 and 615 so as to contact the mandrel 611, and two cylinders 618 and 619 for driving both frames 614 and 615 to open and close.

The cylinders 618 and 619 have cylinder portions rotatably supported on a fixing base 620 via shafts, and have driving ends rotatably attached to side portions of the frames 614 and 615 via shafts.

The band plate coil C wound onto the other mandrel 611 is withdrawn from the mandrel 611, and carried by a trolley 621.

Thus, the band plate 602 that has run on a roller table 600 of the rolling equipment line and has left a pinch roll 601 is guided to the mandrel 611 within the wrapping device 612. Then, the band plate 602 is pressed against an outer surface of the mandrel 611 under tension of the belt or chain member 617. During this action, the band plate 602 is formed into a band plate coil C by the winding action of the mandrel 611.

When the diameter of the band plate coil C has become large, the cylinders 618 and 619 are driven in a contracted manner to release the belt or chain member 617. The support frame 610 is turned 180° clockwise, and brought to a halt.

Then, the belt or chain member 617 is delivered to the surroundings of an unloaded mandrel 611. The band plate 602, which enters the band plate coil C supported on the mandrel 611 at the symmetrical position, is cut with a shear (not shown) disposed on the line. A front end of the cut band plate 602 is guided to the empty mandrel 611 inside the belt or chain member 617 to continue similar winding for forming a band plate coil C.

A tail end of the cut band plate 602 on the band plate coil C side, on the other hand, is taken up into the band plate coil C, and then, the winding action of the mandrel 611 is stopped. The band plate coil C on the mandrel 611 is extracted by a hoisting/lowering and traveling operation of the trolley 621, and carried to a next step.

With the band plate winding system using a down coiler shown in FIG. 36, a high-temperature band plate 602 that has been hot rolled can be wound at a high rate expressed as "a plate speed of about 1,000 m/min".

However, there may be a case in which a trailing end of a preceding band plate and a leading end of a succeeding band plate on the rolling line are weld bonded, while being continuously rolled, and are continuously wound. In this case, 2 to 3 down coilers need to be arranged in tandem on the delivery side of the rolling equipment line.

This has posed the problem that the length of the rolling equipment line becomes large, and the installation of the plural down coilers inevitably increases the equipment cost.

With the band plate winding system using a carrousel type winder shown in FIG. 37, the provision of plural mandrels 611 on a single circular support frame 610 reduces the length of the line and the scale of equipment.

However, even when the rotational driving force of the mandrel 611 is increased, the belt or chain driven by this rotational force can not be moved at a high speed. Thus, as high speed a run as made by the down coiler shown in FIG. 36 is impossible with the carrousel type winding of the band plate 602.

When a chain wrapper is used for hot rolling, for example, "a plate speed of about 250 m/min" is the maximum allowable running speed. This device cannot be used in equipment with a plate speed higher than that.

Hence, an object of the present invention is to provide a band plate winding system capable of high speed winding at a low cost.

DISCLOSURE OF THE INVENTION

To attain the above object, a band plate winding system according to the present invention comprises a carrousel type winder having a plurality of individually driven mandrels on a circular support frame provided so as to be rotationally drivable in a vertical plane; and a roll type wrapping device for supporting a plurality of unit rolls each provided so as to be movable forward and backward between a position surrounding the mandrel located at a winding start position of the winder and a retreat position.

Thus, a band plate can be wound under high speed rolling to a degree comparable to that using a conventional down coiler even during hot rolling. Also, the scale of equipment, the size of an installation space, and the cost of equipment can be markedly decreased because of the concomitant use of the carrousel type winder.

The winding start position for winding by the mandrel of the winder is at the same level as a pass line height of the band plate. Thus, the band plate delivered from a delivery side of a rolling equipment line can be smoothly fed to an empty mandrel located at the winding start position.

The roll type wrapping device that supports the plurality of unit rolls is provided on a common shaft of a support base. Thus, the wrapping device can be placed appropriately so as to surround the mandrel.

A unit roll driving device for rotationally driving each of the plurality of unit rolls comprises transmission means which transmits a rotational force of a driving motor in a direction nearly perpendicular to an axis of the unit roll and which pivots integrally with a frame for supporting the unit roll; one of connector portions of the transmission means is connected by a transmission shaft to an end of the unit roll opposed to the one connector portion; and the driving motor is connected to the other connector portion of the transmission means. Thus, the driving motor and the other connector portion of the transmission means can be connected together via a short transmission shaft or directly. Furthermore, the transmission shaft that connects the one connector portion of the transmission means to the end of the unit roll opposed to the one connector portion may be short in length, and can be held at a slight angle. Hence, a system which can be operated safely at a high speed, with vibrations being decreased, can be constructed in a compact size.

The unit roll driving device for rotationally driving each of the plurality of unit rolls comprises a parallel plate provided, outside and apart from a frame for supporting the unit roll, so as to turn integrally with the frame; at least two bevel gear boxes provided on the parallel plate; a transmission shaft for connecting these bevel gear boxes together; a transmission shaft for connecting one of the bevel gear boxes to an end of the unit roll opposed to the one bevel gear box; and a transmission shaft for connecting the other bevel gear box to a driving motor via universal joints. Thus, the transmission shaft that connects the other bevel gear box to the driving motor via the universal joints can be shortened. Furthermore, the transmission shaft that connects the one bevel gear box to the end of the unit roll opposed to the one bevel gear box may be short in length, and can be held at a slight angle. Hence, a system which can be operated safely at a high speed, with vibrations being decreased, can be constructed in a compact size.

A pair of bevel gears in the bevel gear box are constituted at a speed increasing gear ratio. Thus, the transmission shaft that connects the other bevel gear box to the driving motor via the universal joints is rotated at a relatively low speed. As a result, vibrations occurring in this transmission shaft are further suppressed to promote safety. Since the transmission shaft can be rotated at a low speed, moreover, a large allowable inclination angle can be taken for the transmission shaft, and the entire length of the transmission shaft can be shortened further.

The unit roll driving device for rotationally driving the plurality of unit rolls comprises a gear support panel provided, outside and apart from a frame for supporting the unit rolls, so as to pivot integrally with the frame; multi-stage gears placed at a pivot center position on the gear support panel, at positions on nearly the same axes as the unit rolls, and between both of the positions, and mounted and supported on the gear support panel so as to mesh with each other; a driving motor connected to a shaft of the gear placed at the pivot center position among the multi-stage gears, thereby rotationally driving this gear; and transmission shafts for connecting shafts of the gears, placed at the positions on nearly the same axes as the unit rolls among the multi-stage gears, to ends of the unit rolls corresponding to the shafts of the gears. Thus, long transmission shafts are not required for driving the unit rolls. Short transmission shafts which connect the shafts of the gears, placed at the positions on nearly the same axes as the unit rolls, to the ends of the unit rolls corresponding to the shafts of the gears can be used at a small inclination angle. Hence, a system which can be operated safely at a high speed can be constructed in a compact size.

A deflector device for guiding the band plate to the winder comprises an upper deflector roll disposed above a pass line of the band plate upstream of the winder; and upper guide means which is disposed forwardly and backwardly movably so as to be located above the pass line of the band plate between the winder and the upper deflector roll, and which has a lower surface whose upper deflector roll side can be positioned above a horizontal line in contact with a lower portion of the upper deflector roll, the lower surface of the upper guide means being an inclined surface sloping downward toward the winder. Thus, even when the spacing between the upper deflector roll and the upper guide means is great, the front end of the band plate does not enter this spacing, but is positioned below the lower surface of the upper guide means and guided to the winder by this lower surface. Hence, even if the front end of the band plate warps upward, the front end of the band plate can be guided to the winder reliably.

An auxiliary deflector roll is provided which is disposed so as to be movable forward and backward integrally with the upper guide means, and which increases an angle of deflection of the band plate from the upper deflector roll. Thus, the spacing between the upper deflector roll and the upper guide means is set to be slightly greater than the thickness of the band plate. Even if the upper deflector roll side of the lower surface of the upper guide means is set at an even larger height, the auxiliary deflector roll increases the angle of deflection of the band plate from the upper deflector roll so that the upper guide means, etc. do not impede the traveling movement of the band plate. Hence, even if the front end of the band plate warps upward, the front end of the band plate can be guided to the winder more reliably.

The roll type wrapping device for supporting the plurality of unit rolls is constituted such that of the plural unit rolls provided so as to be movable toward and away from the mandrel, the unit roll located above the mandrel is supported by an upper frame which moves toward and away from the mandrel from above the mandrel, while the other unit roll is supported by a lower frame which moves toward and away from the mandrel from below the pass line of the band plate. Thus, the unit roll positioned above the mandrel need not be supported by the lower frame. Hence, the length of the lower frame can be decreased to minimize a space necessary for forward and backward movement, so that the entire system can be downsized.

First guide means for guiding a front end of the band plate to a wrapping entrance of the mandrel is provided on the upper frame. Thus, the band plate can be guided to the mandrel reliably by the first guide means. Whereas the upper frame is moved to a retracted position, a position at which the upper frame does not hinder the movement of the band plate. Hence, the upper frame does not contact the band plate being wound, so that damage to the band plate can be prevented. Furthermore, when the upper frame is pushed outward to the operating position to guide the front end of a cut band plate toward the mandrel located at the winding start position, this front end is delivered to a suitable inclined or parallel posture relative to the pass line of the band plate. By this measure, the front end of the band plate can be guided reliably to the wrapping entrance of the mandrel.

Second guide means facing the pass line of the band plate from above is provided pivotably between a rolling equipment side and the first guide means. Thus, the band plate can be guided to the mandrel further reliably by the second guide means. Whereas the second guide means is pivoted to an inclined state, whereby the second guide means can be brought to a position at which it does not hinder the movement of the band plate toward the mandrel. Hence, the second guide means does not contact the band plate being wound, so that damage to the band plate can be prevented. Furthermore, the second guide means is positioned below the first guide means, whereby the front end of a cut band plate can be guided to the wrapping entrance of the mandrel further reliably and safely.

Interlocking means is provided for moving wrapping guide means backward in association with a backward movement of the unit roll supported by the lower frame, the wrapping guide means being provided, on a front end side of the lower frame opposed to a front end of the upper frame, so as to be movable toward and away from the mandrel. There may be a case in which after the front end of the band plate passes along the wrapping guide means, the wrapping guide means cannot recede when it is attempted to move the wrapping guide means backward. Even in this case, the interlocking means enables the wrapping guide means to recede in association with the backward movement of the unit roll supported by the lower frame. Hence, the front end of the band plate can be prevented from jamming between the wrapping guide means and the mandrel.

The unit roll supported by the upper frame is larger in diameter than the unit roll supported by the lower frame. Thus, the band plate contacts the mandrel at the first entrance with a large roll curved surface, so that the front end of the band plate can be drawn in more reliably along an outer peripheral surface of the mandrel, and the front end of the band plate can be reliably brought upward or downward in an assorted manner. Furthermore, even when the gap between the wrapping guide means and the mandrel is rendered large, the front end of the band plate can be reliably brought upward or downward in an assorted manner. Hence, jamming of the front end of the band plate can be prevented further reliably.

The roll type wrapping device for supporting the plurality of unit rolls is constituted such that a small cylinder for backup of the unit roll supported on a large frame via a panel-like arm among the plurality of unit rolls provided so as to be movable toward and away from a circumferential surface of the mandrel located at the winding start position has a built-in pressure oil chamber containing an amount of a pressure oil enough to absorb and cushion maximum impact force which the unit roll undergoes. Thus, failure of the system and the occurrence of a defective product due to impact force during band plate winding can be resolved, and productivity increased.

The small cylinder for backup of the unit roll comprises an oil chamber for piston stroke having a rod side connected to the panel-like arm and a cylinder side connected to a large frame side, and having a required length for extending and contracting a piston rod; and an oil chamber for impact force cushioning provided to communicate with a head side of the oil chamber for piston stroke. Thus, failure of the system and occurrence of a defective product due to impact force during band plate winding can be resolved, and productivity increased.

The oil chamber for piston stroke and the oil chamber for impact force cushioning are connected together via an intermediate cover portion, and communicate with each other through a flow path inside the intermediate cover portion. Thus, an intermediate part of the long cylinder can be reinforced, and the cylinder can be mounted safely on the large frame by the intermediate cover portion.

The roll type wrapping device for supporting the plurality of unit rolls comprises two unit roll support frames provided so as to derrick and pivot from an upstream side of a rolling equipment line about lower support shafts as centers of rotation until facing the mandrel at a wrapping start position, the two unit roll support frames being each in the form of a frame individually movable between a set mandrel facing position and a set retreat position without interference by each other. Thus, at the time of the switching movement of the two unit roll support frames to a band plate wrapping position and the retreat position, collision and interference between both of the frames are resolved. Hence, damage to the machine and interruption of operation due to their collision or interruption can be eliminated.

Of the two unit roll support frames, the support frame for the upper unit roll is placed externally, while the support frame for the lower unit roll is placed internally, and a shape of the external support frame and a shape of the internal support frame are combined such that the internal support frame is movable to the retreat position when the external support frame has been brought to a band plate wrapping position at which the external support frame faces the mandrel. Thus, at the time of the switching movement of the two unit roll support frames to the band plate wrapping position and the retreat position, collision and interference between both of the frames are resolved. Hence, damage to the machine and interruption of operation due to their collision or interruption can be eliminated.

Of the two unit roll support frames, at least the internally placed support frame for the lower unit roll is mounted detachably on the support shaft by a semi-arcuate divided type boss portion. Thus, mounting and dismounting of the internal frame become markedly easy for maintenance and so forth.

The roll type wrapping device for supporting the plurality of unit rolls supports the unit rolls on a plurality of pivoting frames which pivot so as to be movable toward and away from a circumferential surface of the mandrel located at the winding start position; a first panel-like arm and a second panel-like arm are pivotably provided on at least one of the plurality of pivoting frames, the first panel-like arm having a band plate wrapping guide at a front end thereof, and the second panel-like arm having a band plate wrapping guide at a front end thereof and being provided with the unit roll; and a pivot shaft of the second panel-like arm is placed in a plane of lateral projection of the first panel-like arm at the winding start position. Thus, the distance between the shafts of the shaft-attached portion of the second panel-like arm and the unit roll can be enlarged. Hence, when a reaction force of the band plate is imposed on the unit roll, the panel-like arm can pivot smoothly, so that concentration of stress on the shaft-attached portion is resolved.

A driving shaft for each of the unit rolls is provided on a work side of a rolling equipment line, and a detachable mandrel front end support device is provided opposite a front end of the mandrel located at the winding start position, the mandrel front end support device having a sectional shape passing between the unit rolls facing a circumferential surface of the mandrel at the winding start position, and between unit roll driving systems, and the mandrel front end support device being movable parallel to an axis of the mandrel. Thus, even when the unit roll driving system of the roll type wrapping device is provided on the work side of the rolling equipment line, the mandrel front end support device does not interfere with the driving system for the unit roll. Hence, the mandrel front end support device can be installed safely at the winding start position, and failure of band plate winding by the winder can be resolved.

The detachable mandrel front end support device is adapted to be movably engaged on track elements fixedly placed on a support base in parallel with the axis of the mandrel, and to be moved to a position, at which the detachable mandrel front end support device is attached to or detached from the front end of the mandrel, by driving means placed on the support base. Thus, movement of the detachable mandrel front end support device can be performed easily.

A parallel partition wall is provided, with the mandrel front end support device being sandwiched between the partition wall and a support frame for the unit roll, and pivots integrally with, but apart from, the support frame; and the unit roll driving system is provided, with the partition wall serving as an intermediate support point. Thus, the spacing between the unit roll driving system and the detachable mandrel front end support device becomes easy to maintain, and the unit roll driving system can be downsized.

BEST MODE FOR CARRYING OUT THE INVENTION

A band plate winding system according to the present invention will now be described in detail by way of the following embodiments with reference to the accompanying drawings.

[First Embodiment]

Figure 1:
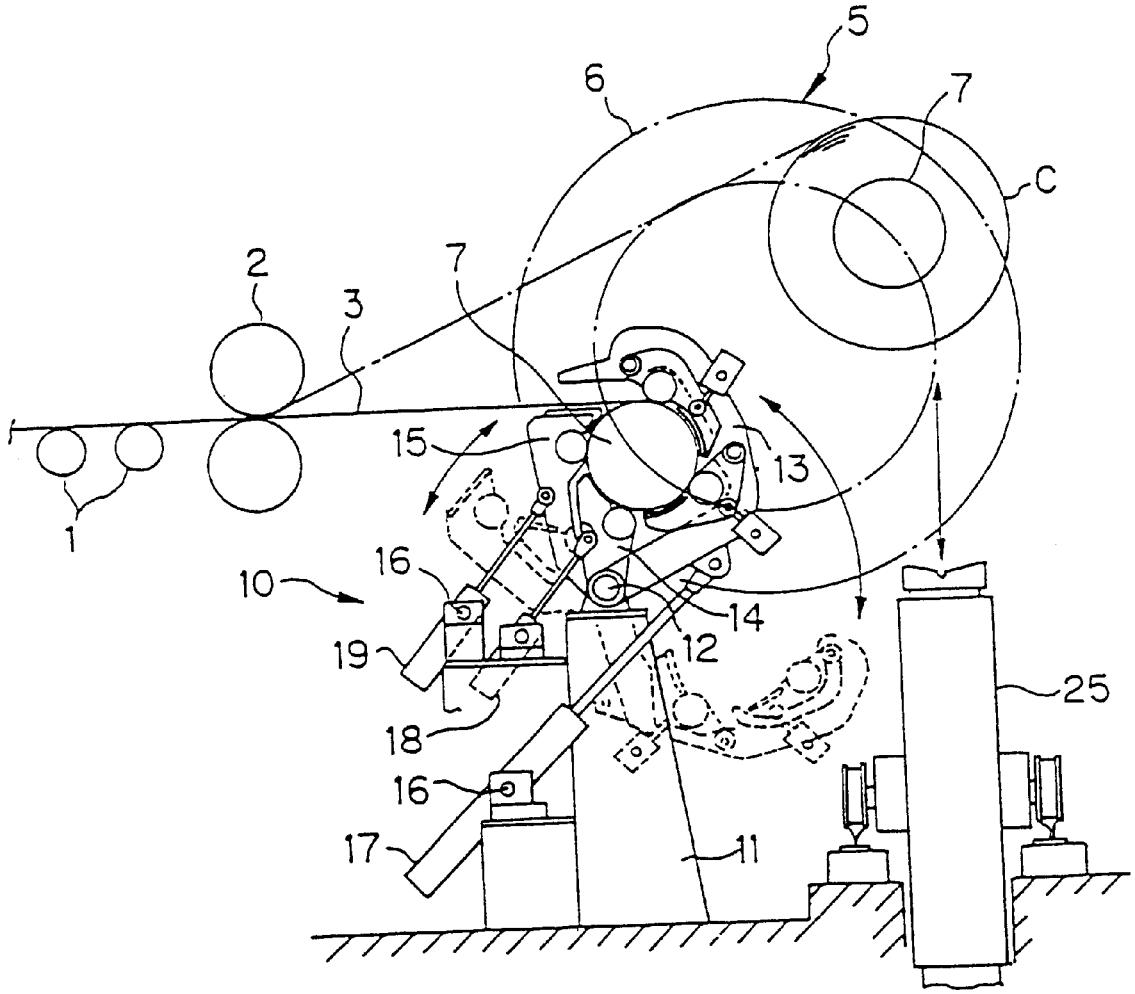
FIG. 1 is a schematic side view of a band plate winding system showing a first embodiment of the present invention.
Figure 2:
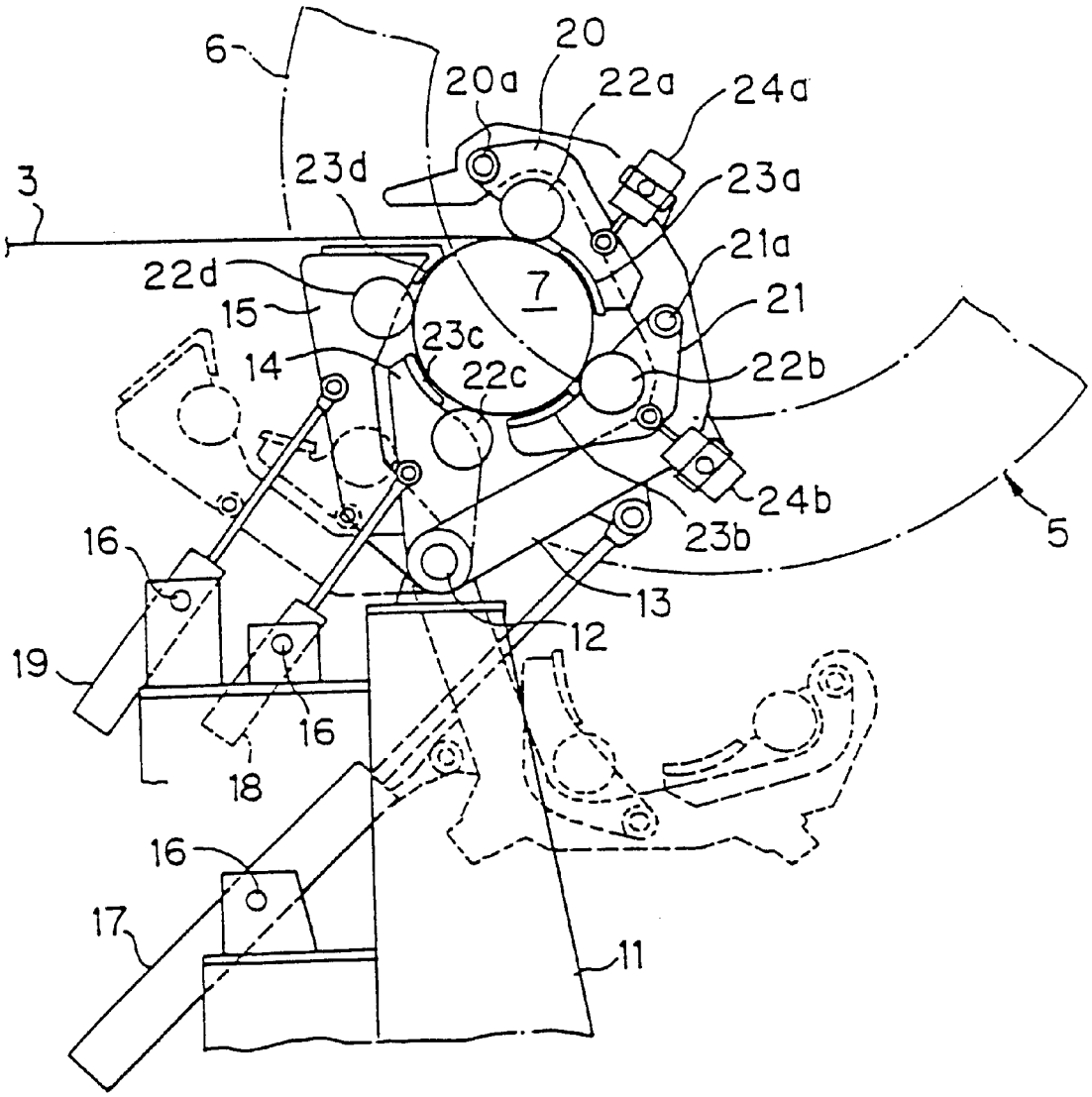
FIG. 2 is an enlarged side view of an essential part of FIG. 1.

FIG. 1 is a schematic side view of a band plate winding system showing a first embodiment of the present invention. FIG. 2 is an enlarged side view of an essential part of FIG. 1.

As shown in FIG. 1, a carrousel type double-drum winder 5 is placed on a delivery side of a rolling equipment line. This winder 5 is composed of a circular support frame 6 to be rotationally driven in a vertical plane, and two individually drivable mandrels 7, 7 provided at symmetrical positions of the circular support frame 6. The two mandrels 7, 7 on the circular support frame 6 have a winding start position which is a pass line height position of a band plate 3 close to the delivery side of the rolling equipment line.

A roll type wrapping device 10 is placed so as to be movable between a position, at which the wrapping device 10 surrounds the mandrel 7 stopped at the winding start position, and a retreat position at which the wrapping device 10 does not interfere with the turning of the circular support frame 6.

The wrapping device 10 has three pairs of large and small arm-shaped frames (i.e., a pair of arm-shaped frames 13, a pair of arm-shaped frames 14 and a pair of arm-shaped frames 15) extending so as to surround the mandrel 7, with one end of each frame being supported by a common shaft 12 on a support base 11 placed below the mandrel 7 located at the winding start position and near the delivery side of the rolling equipment line; and three pairs of frame opening and closing cylinders (i.e., a pair of opening and closing cylinders 17, a pair of opening and closing cylinders 18, and a pair of opening and closing cylinders 19) each having a rod end connected to an outer portion of each of the frames 13 to 15, and having a cylinder portion connected onto the support base 11 by a shaft 16 in a configuration in which the cylinders pivot the frames 13 to 15 to the retreat position.

The pair of frames 13, as shown in FIG. 2, extend from below toward a rear surface of the mandrel 7 in, and have at a front end portion and an intermediate portion thereof two panel-like arms 20, 21 connected at one end onto the frames 13 by shafts 20*a* and 21*a*. The two panel-like arms 20, 21 are provided, respectively, with a unit roll 22*a* and a presser plate 23*a*, and a unit roll 22*b* and a presser plate 23*b*, which come into contact with the band plate 3 onto the mandrel 7. Between an intermediate portion of each of the arms 20 and 21 and the frame 13, small cylinders 24*a*, 24*b* are provided for pressing the unit rolls and the presser plates against a surface of the mandrel 7.

The pair of frames 14 are in a size comparable to that of the panel-like arms 20, 21, extend to an outer lower half surface of the mandrel 7. Like the panel-like arms 20, 21, the frame 14 is provided with a unit roll 22*c* and a presser plate 23*c*, which are to be pushed against the surface of the mandrel 7 by the opening and closing cylinder 18.

The pair of frames 15 extend to pass above the frame 14 and face an upper outer surface of the mandrel 7. Similarly, the frame 15 is provided with a unit roll 22*d* and a presser plate 23*d*, which are to be pushed against the surface of the mandrel 7 by the opening and closing cylinder 19.

The four unit rolls 22*a* to 22*d* and presser plates 23*a* to 23*d* are adapted to press the band plate 3 being wound by the mandrel 7 against the surface of the mandrel 7 at four circumferentially spaced locations with an adjusted force, thereby shaping it.

Furthermore, a trolley 25 is provided for taking a coil C, wound onto the other mandrel 7 on the circular support frame 6, out of the mandrel 7 and carrying the coil C.

The band plate winding system of the present invention constituted as above is used in the following manner:

During rolling operation, the winder S turns the circular support frame 6 clockwise to send an empty mandrel 7 sequentially to the winding start position, and stops.

At this time, the wrapping device 10 contracts the cylinders 17 to 19 to move the frames 13 to 15 to the retreat position indicated by dashed lines, and enters await state. After the empty mandrel 7 moves to and stops at the winding start position, the cylinders 17 to 19 are extended to bring the frames 13 to 15 to positions indicated by solid lines in the surroundings of the empty mandrel 7.

The band plate 3, which runs on a roller table 1 and is delivered from a pinch roll 2 on the delivery side of the rolling equipment line, is guided by guide rollers onto the empty mandrel 7 located at the winding start position.

The band plate 3 begins to be pressed by the unit rolls 22*a* to 22*d* of the wrapping device 10, and wound by the mandrel 7 at the same time, whereby a coil C of the band plate 3 is formed on the mandrel 7.

At this time, bulges of the band plate 3 between the unit rolls 22*a* to 22*d* are prevented by the presser plates 23*a* to 23*d*.

At a time when a predetermined length of the band plate 3 has been wound, the wrapping device 10 is released and moved to the retreat position shown by the dashed line. The circular support frame 6 of the winder 5 is turned a half turn clockwise to move an empty mandrel 7 to the winding start position and stop it there.

The wrapping device 10 is sent to the solid-line position to make it ready for winding of a next band plate 3.

The band plate 3 is cut with a shear on the delivery side of the rolling equipment line. A tail end side of the cut band plate 3 is guided by guide means, whereupon winding of the band plate 3 onto the mandrel 7 moved to an upper right position of the circular support frame 6 is completed. At this time, winding of this mandrel 7 is stopped.

A front end of the cut band plate 3 is guided by guide rollers onto an empty mandrel 7 located at the winding start position, and the same winding of the band plate 3 as described above is repeated.

The coil C on the upper right mandrel 7 that has finished winding is taken out by the trolley 25 from the mandrel 7, and carried to a subsequent step.

Figure 36:
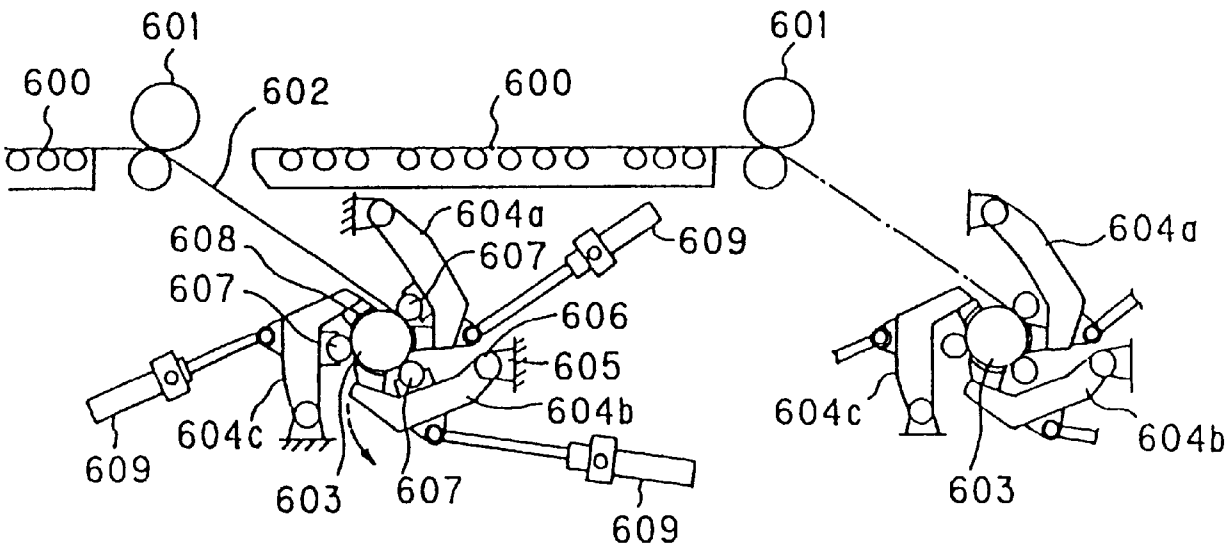
Fig.36 Conventional Art
FIG. 36 is a schematic side view showing an example of a conventional band plate winding system.
Figure 37:
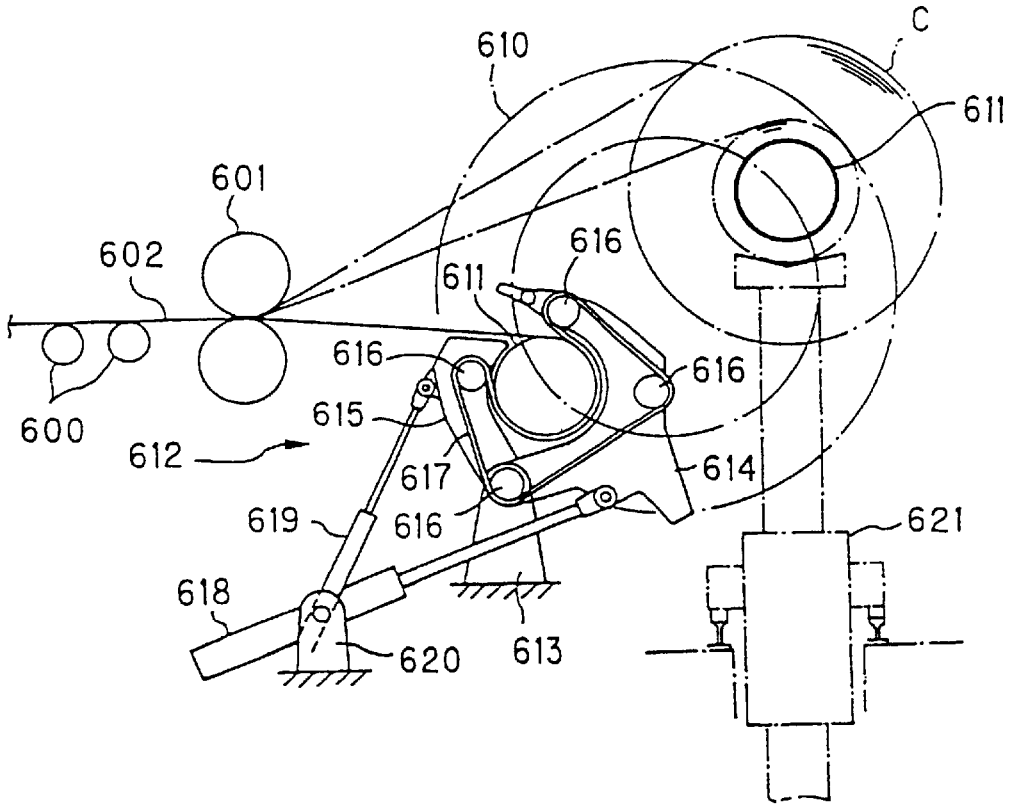
Fig.37 Conventional Art
FIG. 37 is a schematic side view showing another example of a conventional band plate winding system.

On this occasion, the wrapping device 10 is constituted to be of a roll type having the plurality of unit rolls 22*a* to 22*d*. Thus, even during hot rolling, winding of the band plate 3 under high speed rolling at a speed as fast as "a plate speed of 1,000 m/min" can be performed as with a conventional down coiler (FIG. 36).

Also, the carrousel type (double-drum type) winder 5 can be used concomitantly, so that the scale of equipment, the size of an installation space, and the cost of equipment can be markedly decreased.

The foregoing embodiment shows an example in which the four unit rolls are present, but three or more unit rolls may be used.

[Second Embodiment]

Figure 3:
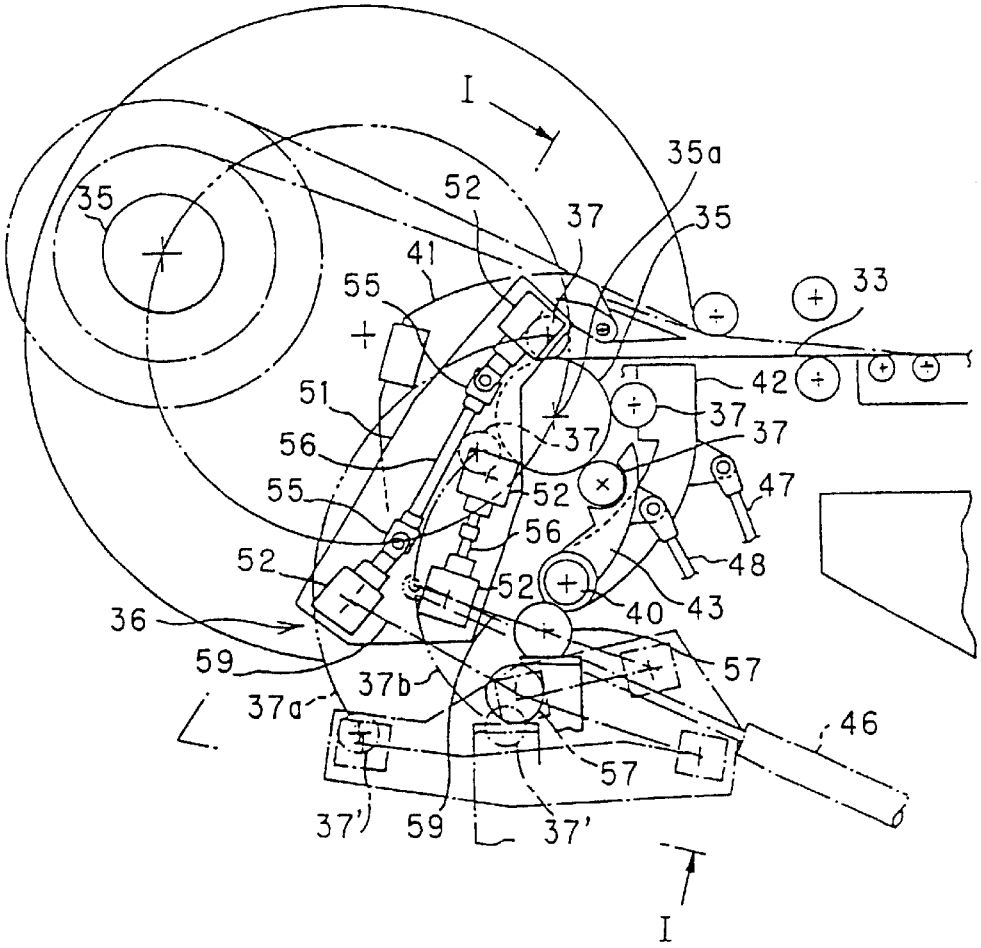
FIG. 3 is a schematic side view of a unit roll driving device showing a second embodiment of the present invention.
Figure 4:
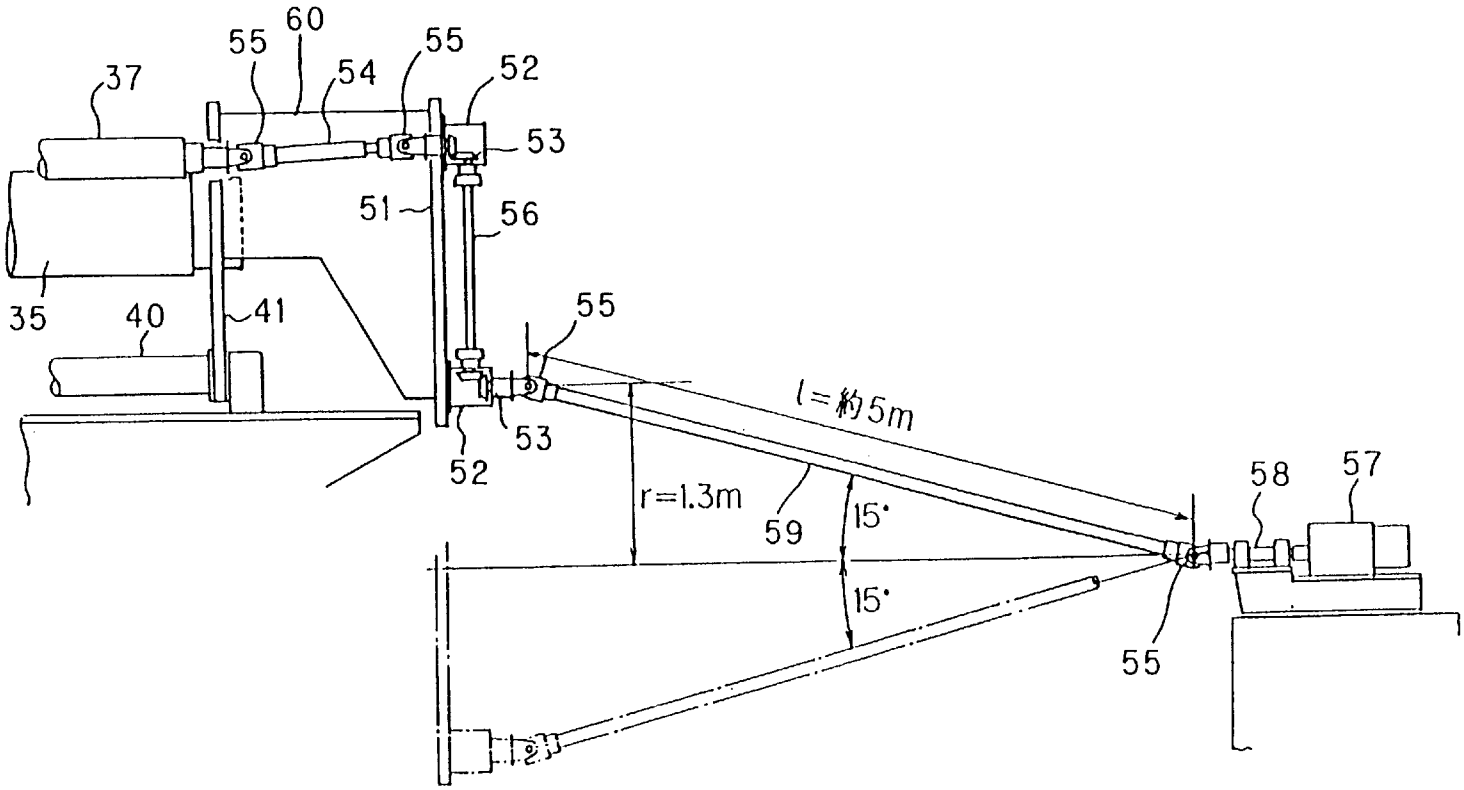
FIG. 4 is a development sectional view taken along line I—I of FIG. 3.

FIG. 3 is a schematic side view of a unit roll driving device showing a second embodiment of the present invention. FIG. 4 is a development sectional view taken along line I—I of FIG. 3.

In FIGS. 3 and 4, the reference numeral 51 denotes a parallel plate. This parallel plate 51 is fixedly supported via a binding material 60 on an outside of a large frame 41 on a front end side of a mandrel 35, and is provided parallel at a distance from the large frame 41. The parallel plate 51 is also constituted to have a shape spreading along loci 37*a*, 37*b* ranging from positions at which it faces ends of two unit rolls 37, 37 on the large frame 41, to retracted positions 37', 37' to which the unit rolls 37, 37 on the large frame 41 move.

On an outer surface of the parallel plate 51, four bevel gear boxes 52 are fixed. Of them, the upper two bevel gear boxes 52 are placed at positions opposed to the ends of the unit rolls 37, 37 on the large frame 41, while the lower two bevel gear boxes 52 are placed at the other end and an obliquely lower portion of the parallel plate 51 along the loci 37*a*, 37*b* of the unit rolls 37, 37 on the large frame 41 moving to their retracted positions 37', 37'.

In FIG. 4, the reference numeral 53 denotes a pair of perpendicularly intersecting bidirectional bevel gears rotatably supported in each bevel gear box 52 via bearings. The reference numeral 54 denotes a transmission shaft connected via universal joints 55 between an end portion of each of the unit rolls 37, 37 on the large frame 41 and a shaft end of the bevel gear 53 of the bevel gear box 52 corresponding to the end portion. The reference numeral 56 denotes a transmission shaft fixedly connected between shaft ends of each pair of bevel gear boxes 52 along the movement loci 37*a*, 37*b*. The reference numeral 57 denotes a unit roll driving motor installed near the height of the parallel plate 51 when retracted. The reference numeral 58 denotes an output shaft of the driving motor 57. The reference numeral 59 denotes a transmission shaft connected via universal joints 55 between the end of a horizontal shaft of the lower bevel gear box 52 on the parallel plate 51 and the end of the motor output shaft 58.

That is, the upper bevel gear box 52 and the lower bevel gear box 52 are connected together by the transmission shaft 56. The upper bevel gear box 52 and the end of the unit roll 37 opposed to the upper bevel gear box 52 are connected together by the transmission shaft 54 via the universal joints 55. The lower bevel gear box 52 and the driving motor 57 are connected together by the transmission shaft 59 via the universal joints 55. The driving motor 57 is placed at a position at which the angle of inclination of the transmission shaft 59 is kept within 15°.

FIG. 4 shows only the unit roll 37 located at the front end side of the large frame 41, and the driving system therefor. However, the same driving system as this one is constituted for the unit roll 37 on the intermediate portion side of the large frame 41. The other constitution is the same as in the first embodiment, and a detailed explanation will be omitted herein by reference to the first embodiment.

According to the system of the above constitution, the large frame 41 of a wrapping device 36 is moved between an operating position, which is opposed to a mandrel 35 moved to a winding start position 35*a*, and a retracted position 41' (see FIG. 6) upon extension and contraction of a driving cylinder 46. Other frames, i.e., a medium frame 42 and a small frame 43, are also moved between the operating position and the retracted position simultaneously upon extension and contraction of driving cylinders 47, 48. The parallel plate 51 is moved between the operating position and the retracted position integrally with the large frame 41.

In a state in which the large frame 41 and the parallel plate 51 have been brought to the operating position indicated by a solid line in FIGS. 3 and 4, the mandrel 35 and the unit roll 37 are rotationally driven to wrap a band plate 33 delivered from a rolling line around the mandrel 35.

At this time, the unit roll 37 is rotationally driven by the driving motor 57. That is, a rotational force of the driving motor 57 is transmitted to the bevel gear box 52 via the transmission shaft 59. Then, this force is transmitted by the bevel gear box 52 and the transmission shaft 56 in a direction perpendicular to the axis of the unit roll 37. The force is further transmitted to the unit roll 37 by the transmission shaft 54.

At the completion of winding of the band plate 33 onto the mandrel 35, driving by the driving motor 57 is stopped. Upon contraction of the driving cylinders 46 to 48, the frames 41 to 43 and the parallel plate 51 are moved to retracted positions indicated by one-dot chain lines in the drawing. At this time, the transmission shaft 59 keeps a constant angle of inclination (e.g., 15°), with the universal joint 55 at the end of the motor output shaft 58 as a fixed point, and with the universal joint 55 at the end of the lower bevel gear box 52 as a moving point. In this manner, the transmission shaft 59 pivots between the operating position and the retracted position. A radius of pivoting, r, of the universal joint 55 on the lower bevel gear box 52 side about the axis of the motor output shaft 58 is about r=1.3 m on an actual machine basis. Thus, the radius of pivoting, r, can be reduced by a little more than 20% compared with conventional systems.

Under these conditions (angle of inclination: 15°, radius of pivoting: 1.3 m), the transmission shaft 59 is connected between the lower bevel gear box 52 and the driving motor 57. By so doing, the length, l, of the transmission shaft 59 is halved to a little more than about 5 m, as shown in FIG. 4.

The transmission shaft 54 between the upper bevel gear box 52 and the unit roll 37 may be short, and can be held at a slight angle of inclination, even if a gap allowance by the driving cylinder for the panel-like arm is included.

According to the unit roll driving device of the present embodiment, therefore, there can be provided a system of a compact size in which the length of the transmission shaft 59 for driving of the unit roll can be shortened to decrease vibrations, and which can be operated safely at a high speed with a large angle of inclination.

[Third Embodiment]

Figure 5:
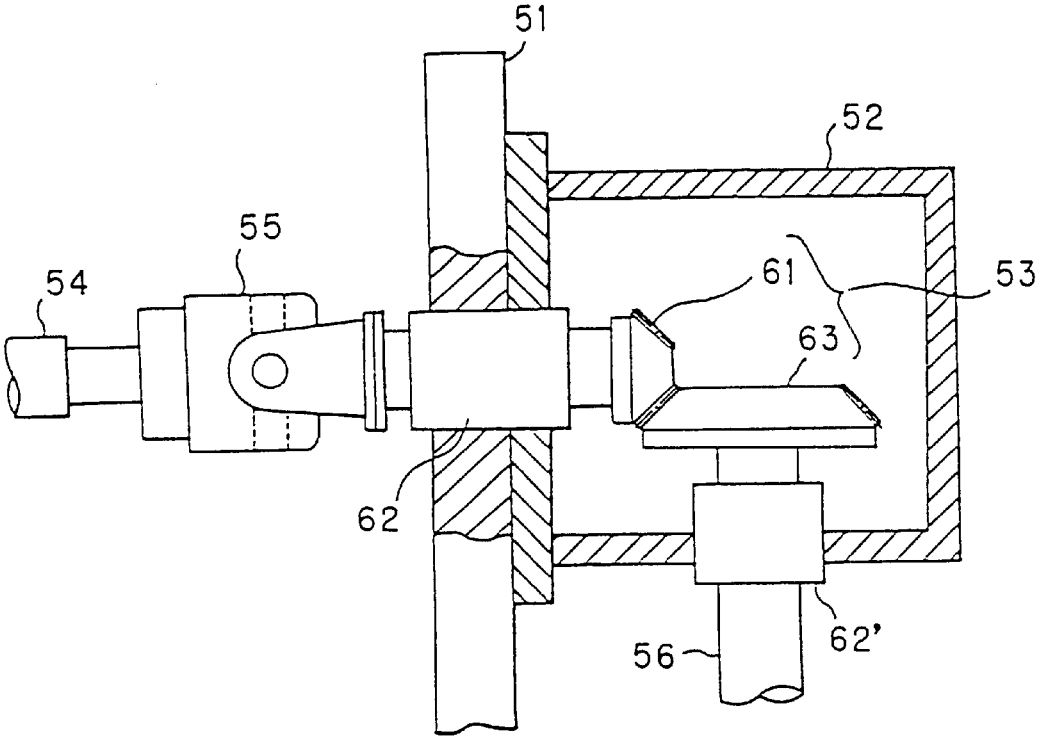
FIG. 5 is a side view of the constitution of bevel gears of a unit roll driving device showing a third embodiment of the present invention.

FIG. 5 is a side view of the constitution of bevel gears of a unit roll driving device showing a third embodiment of the present invention.

The driving device of this embodiment is the unit roll driving device of the second embodiment constituted with a change in the gear ratio of the pair of bevel gears 53 inside the bevel gear box 52.

In FIG. 5, the reference 52 denotes a bevel gear box corresponding to the two unit rolls 37 on the large frame 41. Within the bevel gear box 52, bevel gears 61, 63 are provided as a pair of bevel gears 53. The bevel gear 61 is supported by a bearing 62 of the bevel gear box 52, and connected to a transmission shaft 54. Whereas the bevel gear 63 is supported by a bearing 62', and connected to a transmission shaft 56.

FIG. 5 shows a case in which the gear ratio between the bevel gears 61 and 63 is set at ½, so that revolutions on the part of the transmission shaft 56 are doubled and transmitted to the transmission shaft 54 on the part of the unit roll 37. This gear ratio is not restricted to ½, but may be set as necessary. A speed increasing gear ratio may also be applied to the bevel gears of the lower bevel gear box 52 to increase the speed progressively.

When such a speed increasing gear ratio is used, for instance, when the gear ratio between the bevel gears 61 and 63 is set at ½, driving the output shaft 58 of the driving motor 57 and the transmission shaft 59 in FIG. 4 at 700 revolutions per minute enables the unit roll 37 side to be driven at predetermined 1400 revolutions per minute.

Thus, according to the unit roll driving device of the present embodiment, the transmission shaft 59 is rotated at a relatively low speed. Consequently, vibrations occurring in the transmission shaft 59 are further suppressed, and safety is enhanced. Since the transmission shaft 59 can be rotated at a low speed, the allowable angle of inclination of the transmission shaft 59 can be made large, and the entire length of the transmission shaft 59 can be shortened further.

[Fourth Embodiment]

Figure 6:
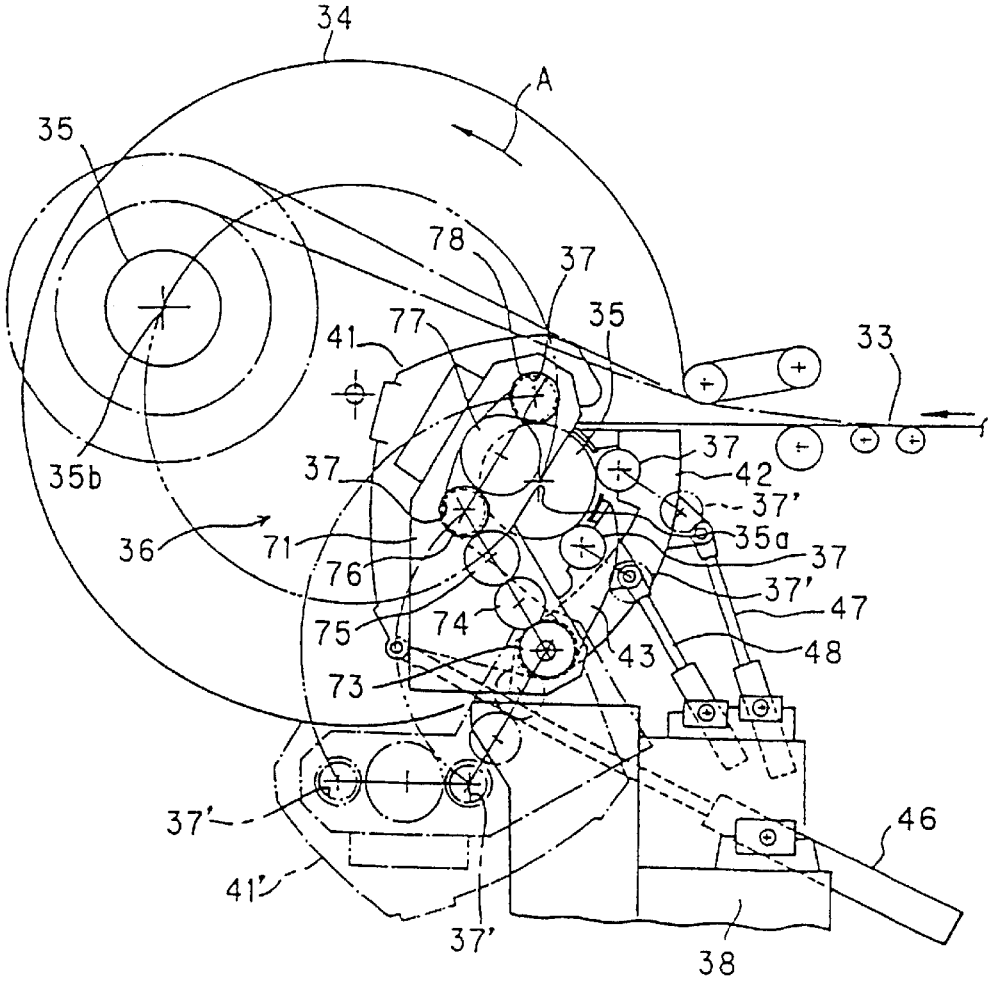
FIG. 6 is a schematic side view of a unit roll driving device showing a fourth embodiment of the present invention.
Figure 7:
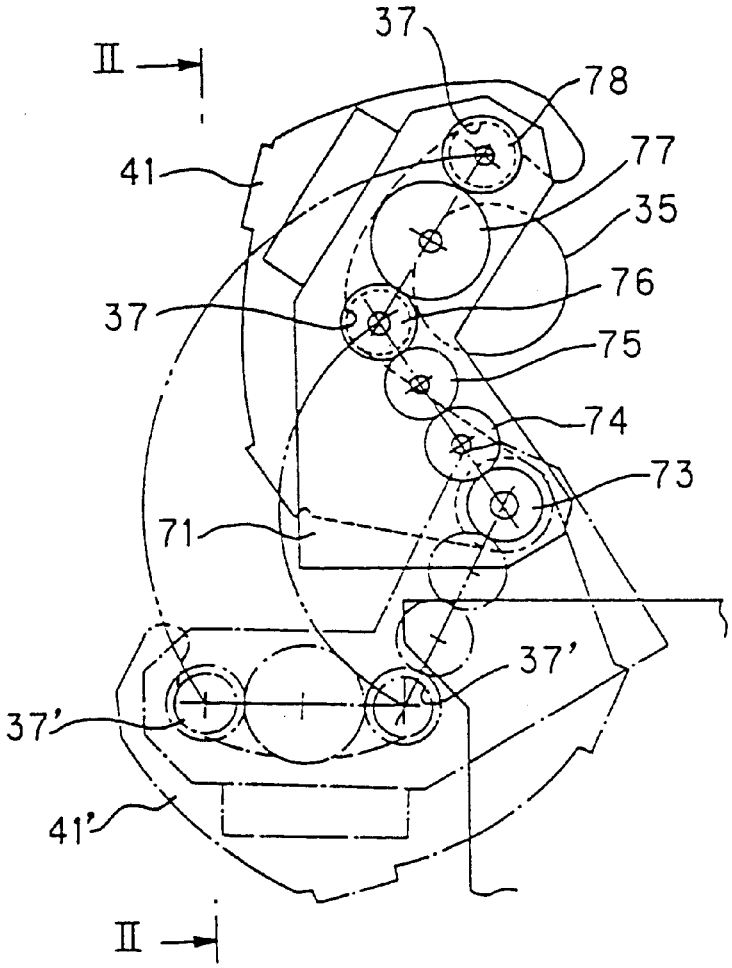
FIG. 7 is an enlarged side view of a multi-stage gear transmission mechanism in FIG. 6.
Figure 8:
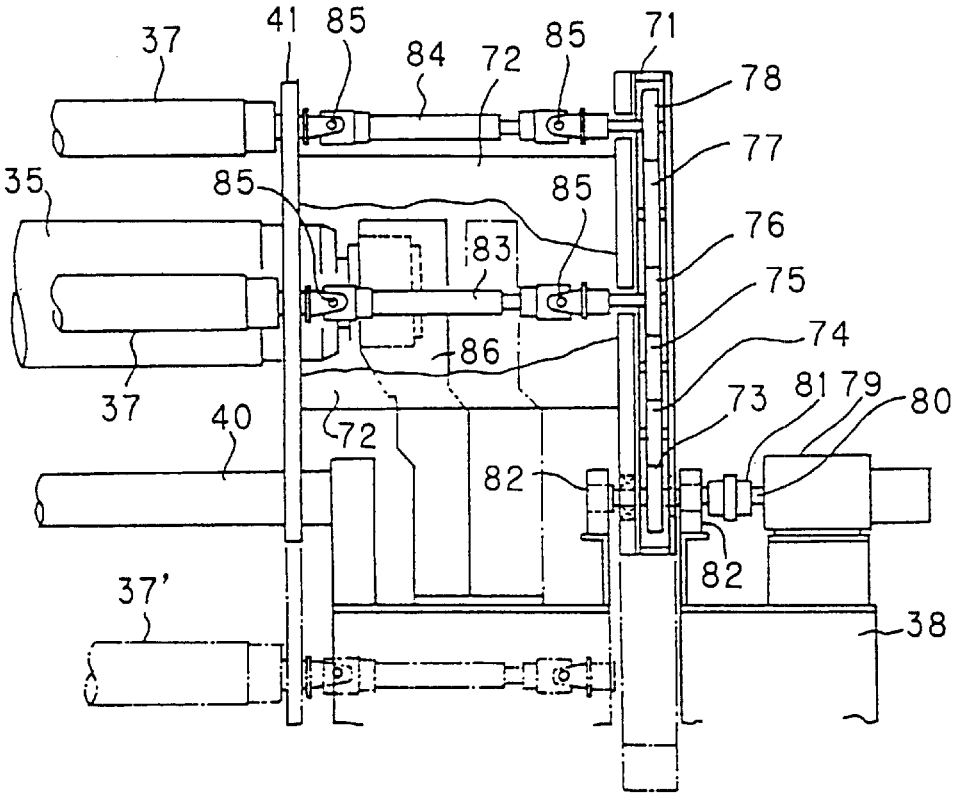
FIG. 8 is a front view taken on line II—II of FIG. 7.

FIG. 6 is a schematic side view of a unit roll driving device showing a fourth embodiment of the present invention. FIG. 7 is an enlarged side view of a multi-stage gear transmission mechanism in FIG. 6. FIG. 8 is a front view taken on line II—II of FIG. 7.

In FIGS. 6 and 8, the reference numeral 71 denotes a gear support panel. The gear support panel 71 is fixedly supported via a binding material 72 on an outside of a large frame 41 at a front end side of a mandrel 35, and is provided in parallel with and apart from the large frame 41. The gear support panel 71 is formed in a range extending from a position at which it covers end portions of two unit rolls 37, 37 on the large frame 41, to a position at which it covers a support shaft 40 for the large frame 41. As shown in FIG. 8, the gear support panel 71 contains six gears 73, 74, 75, 76, 77 and 78 meshing in multiple stages. These gears 73 to 78 are each supported via a bearing (not shown) on the gear support panel 71. In FIGS. 6 and 7, these built-in gears 73 to 78 are illustrated in an exposed state.

The first-stage gear 73 is supported by the gear support panel 71 coaxially with the support shaft 40 for the large frame 41. The shaft of this first-stage gear 73 is coupled via a coupling 81 to an output shaft 80 of a driving motor 79 provided on and adjacent a base 38. The shaft of this first-stage gear 73 is also supported by a bearing 82 on the base 38 together with the gear support panel 71.

The fourth-stage gear 76 and the sixth-stage gear 78 have the same diameter, and are rotatably provided on the gear support panel 71 at positions nearly coaxial with the intermediate and upper unit rolls 37, 37 on the large frame 41. The second-stage gear 74 and the third-stage gear 75 are placed linearly between the first-stage gear 73 and the fourth-stage gear 76 to transmit a rotational force of the first-stage gear 73 to the fourth-stage gear 76. The fifth-stage gear 77 is placed linearly between the fourth-stage gear 76 and the sixth-stage gear 78 to transmit the rotational force.

These multi-stage gears 73 to 78 may be arranged on as stated above, or may be arranged zigzag with the second-, third- and fifth-stage gears being displaced right and left. In FIGS. 6 to 8, the first-stage gear 73 to the fourth-stage gear 76 are shown to have the same diameter. However, these gears, from 73 to 76, may be gears having a speed increasing ratio.

In FIG. 8, the reference numerals 83 and 84 denote extendable transmission shafts connected via universal joints 85 between the shafts of the fourth-stage gear 76 and the sixth-stage gear 78 and end portions of the unit rolls 37, 37 corresponding to these shafts. That is, the shafts of the gears 76, 78 at positions nearly coaxial with the unit rolls 37, 37 on the large frame 41, and the ends of the unit rolls 37, 37 corresponding to these gear shafts, are interconnected by the transmission shafts 83, 84. The reference numeral 86 in FIG. 8 denotes a moving bearing which attaches to or detaches from the front end of a mandrel 35. The other constitutions are the same as in the first embodiment, and a detailed explanation for them will be omitted by referring to the first embodiment.

According to the system of the above constitution, the large frame 41 of a wrapping device 36 is conveyed between an operating position, which is opposed to the mandrel 35 moved to a winding start position 35*a*, and a retracted position 41', by the extension and contraction of a driving cylinder 46. Simultaneously, a medium frame 42 and a small frame 43 are also conveyed between an operating position and a retracted position by the extension and contraction of driving cylinders 47, 48. The gear support panel 71 is moved between an operating position and a retracted position integrally with the large frame 41.

In a state in which the large frame 41 and the gear support panel 71 have been fed to the operating position indicated by solid lines in FIGS. 6 to 8, the mandrel 35 and the unit rolls 37 are rotationally driven to wrap a band plate 33 delivered from the rolling line around the mandrel 35.

When, on this occasion, the output shaft 80 is driven at 1,400 rpm by the driving motor 79, the first-stage gear 73 is rotated at the same revolution speed. These revolutions are sequentially transmitted to the multistage gears 74 to 78, whereby the fourth-stage gear 76 and the sixth-stage gear 78 are rotated at the same speed in the same direction. That is, the rotational force of the driving motor 79 is transmitted by the multi-stage gears 73 to 78 in a direction perpendicular to the axis of the unit roll 37. Revolutions of the fourth-stage gear 76 and the sixth-stage gear 78 are transmitted to the unit rolls 37 via the transmission shafts 83, 84, respectively, whereupon the unit rolls 37 are rotated in the same direction at the same speed.

When the multi-stage gears 73 to 76 are constituted to have a constant speed increasing gear ratio, the motor output shaft 80 is rotated at a low speed (e.g., 700 rpm), and the fourth-stage gear 76 and the sixth-stage gear 78 (accordingly, the unit rolls 37) can be rotated at a high speed (1,400 rpm).

At this time, the gear support panel 71 may be provided at a position relatively close to the end of the mandrel 35. Thus, the transmission shafts 83, 84 interconnecting the unit rolls 37 to the fourth-stage gear 76 and the sixth-stage gear 78 may be used with a short length and a gentle angle of inclination. Upon driving by the driving motor 79 located at a very near position, the transmission shafts 83, 84 can transmit a rotational force, necessary for winding of the band plate 33, to the two unit rolls 37, 37 in the same direction at the same speed. Moreover, the entire system can be constituted in a very compact size.

Arrangement of the multi-stage gears 73 to 78 on a line facilitates the placement of the binding material 72 between the large frame 41 and the gear support panel 71.

At the completion of winding of the band plate 33 onto the mandrel 35, driving by the driving motor 79 is stopped. Upon contraction of the driving cylinders 46 to 48, the frames 41 to 43 are moved to retracted positions. The large frame 41 and the gear support panel 71 are turned integrally about the support shaft 40, and the unit rolls 37, 37 are moved to retracted positions 37' shown in FIGS. 7 and 8.

Then, a circular support frame 34 is turned in a direction of an arrow A, whereupon the mandrel 35 at the winding start position 35*a* moves to a winding completion position 35*b*. An empty mandrel 35 at the winding completion position 35*b* moves to the winding start position 35*a*. The winding unit roll 37 is sent to the operating position again, and similar winding of the band plate 33 is repeated.

According to the unit roll driving device of the present embodiment, therefore, a long transmission shaft is not required for the driving of the unit roll 37, and the short transmission shafts 83, 84 can be used with a small angle of inclination. Thus, a compact system which can be operated safely at a high speed can be provided.

[Fifth Embodiment]

Figure 9:
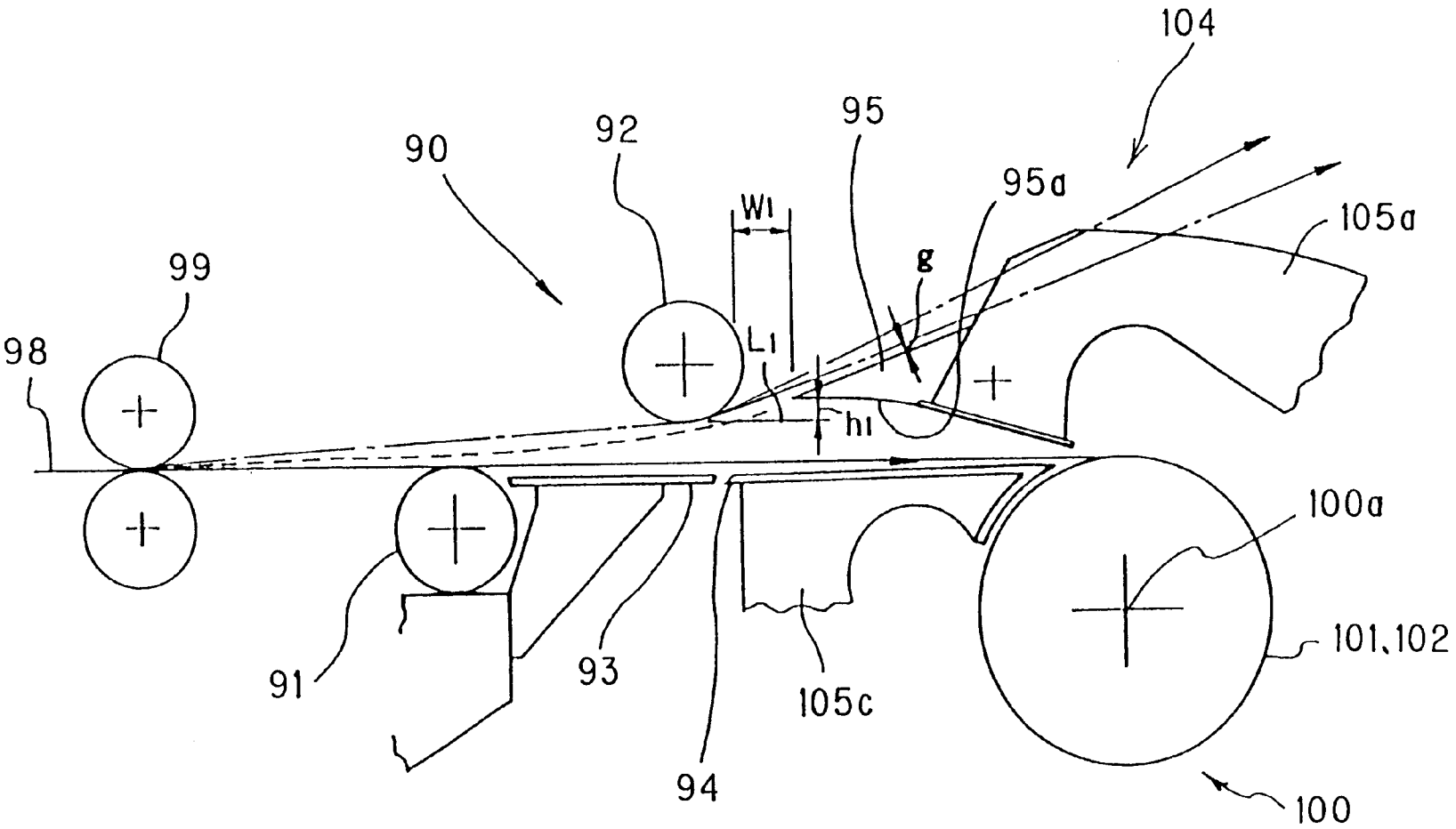
FIG. 9 is a schematic side view of a deflector device showing a fifth embodiment of the present invention.

FIG. 9 is a schematic side view of a deflector device showing a fifth embodiment of the present invention.

As shown in FIG. 9, a lower deflector roll 91 is disposed below a pass line of a band plate 98 beside a pinch roll 99 between the pinch roll 99 and a wrapping device 104. Above a pass line of the band plate 98 on the wrapping device 104 side (upstream of a winder 100) between the pinch roll 99 and the wrapping device 104, an upper deflector roll 92 is disposed. Below a pass line of the band plate 98 between the lower deflector roll 91 and the wrapping device 104, entrance guide means 93 is disposed. To a front end of a medium frame 105*c* of the wrapping device 104, lower guide means 94 is attached. To a front end of a large frame 105*a* of the wrapping device 104, upper guide means 95 is attached.

In the upper guide means 95, a front end of its downward guide surface 95*a* is positioned at a necessary and sufficient height, $h_1$, from a horizontal $L_1$ in contact with a lower part of the upper deflector roll 92. Furthermore, the downward guide surface 95*a* forms an inclined surface as a gently curved surface or a flat surface sloping downward toward mandrels 101, 102 of the winder 100. A gap, g, between the band plate 98, which runs sloping upward, beginning at the upper deflector roll 92, and the upper guide means 95 is set to be slightly greater than the thickness, of the band plate 98 (by several millimeters).

That is, the upper guide means 95 is disposed forwardly and backwardly movably so that the upper guide means 95 can be located above the pass line of the band plate 98 between the winder 100 and the upper deflector roll 92. The upper deflector roll 92 side (front end) of its downward guide surface 95*a* (lower surface) can be positioned above the horizontal line $L_1$, and the downward guide surface 95*a* forms an inclined surface sloping downward toward the winder 100.

The above-mentioned lower deflector roll 91, upper deflector roll 92, entrance guide means 93, lower guide means 94, and upper guide means 95 together constitute a deflector device 90 of the present embodiment. The other constitutions are the same as in the first embodiment, and a detailed explanation for them will be omitted by reference to the first embodiment.

According to such a deflector device 90, the upper deflector roll 92 side of its downward guide surface 95*a* can be positioned above the horizontal line $L_1$. Thus, even when a spacing $w_1$ in the horizontal direction between the upper deflector roll 92 and the front end of the upper guide means 95 is large, the front end of the band plate 98 being fed at a high speed from the rolling equipment is not allowed to enter this spacing $w_1$, but can be positioned below the downward guide surface 95*a* of the upper guide means 95. In addition, the downward guide surface 95*a* of the upper guide means 95 forms an inclined surface sloping downward toward the winder 100. Thus, the front end of the band plate 98 can be guided to a wrapping entrance of the mandrels 101, 102 at a winding start position 100*a*.

According to the above deflector device 90, therefore, even if the front end of the band plate 98 warps upward, the front end of the band plate 98 can be guided reliably to the wrapping entrance of the mandrels 101, 102 at the winding start position 100*a*. Hence, the band plate 98 can be continuously wound.

[Sixth Embodiment]

Figure 10:
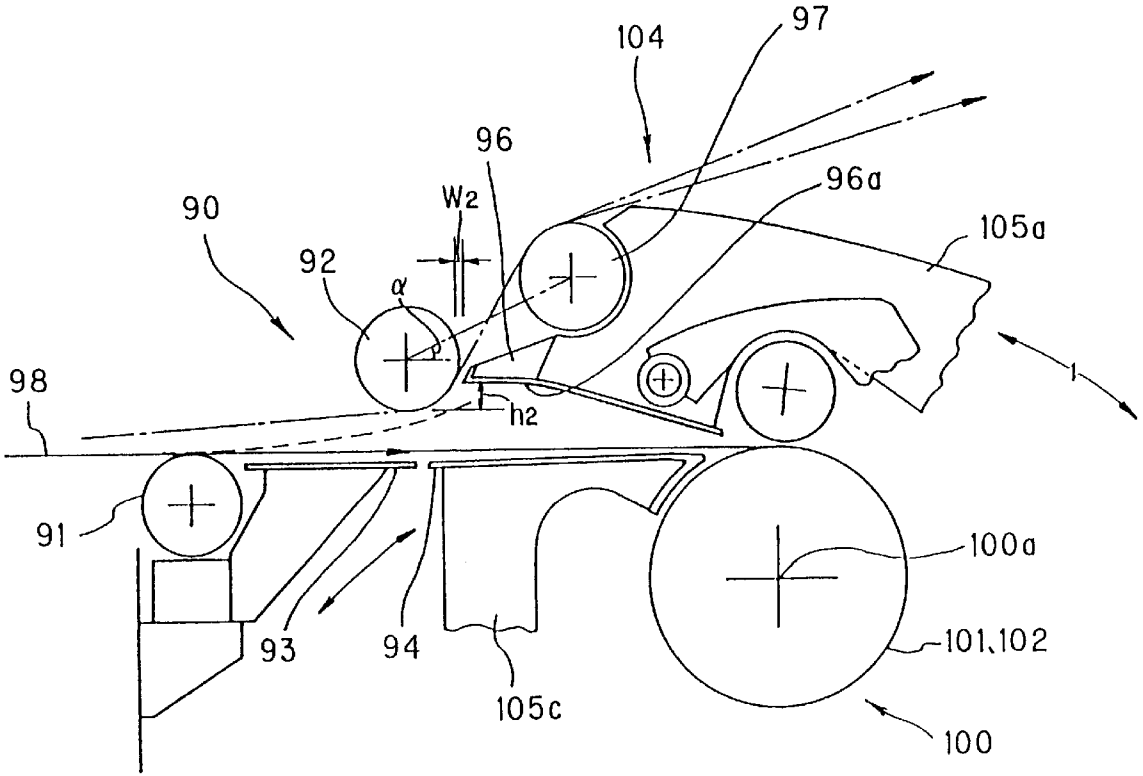
FIG. 10 is a schematic side view of a deflector device showing a sixth embodiment of the present invention.
Figure 11:
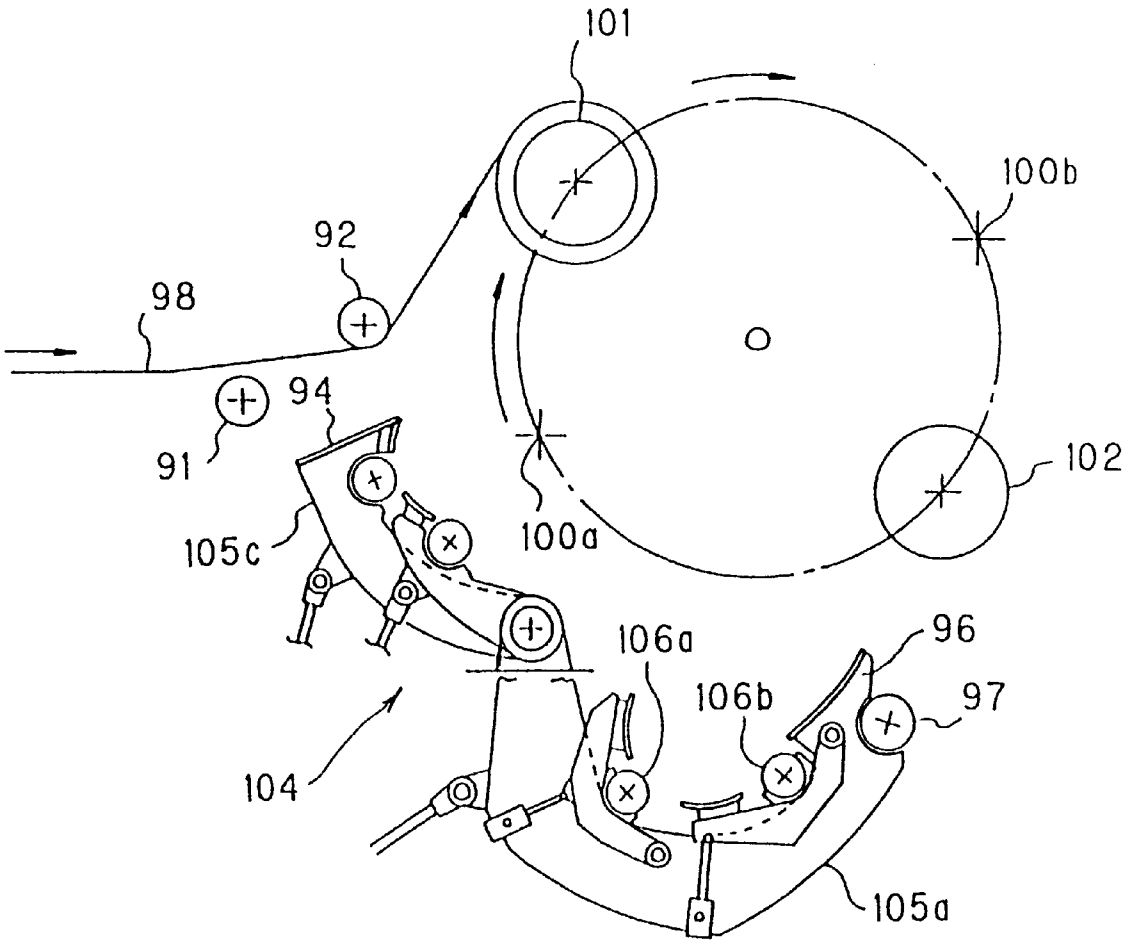
FIG. 11 is an explanation view of the operation of the deflector device.
Figure 12:
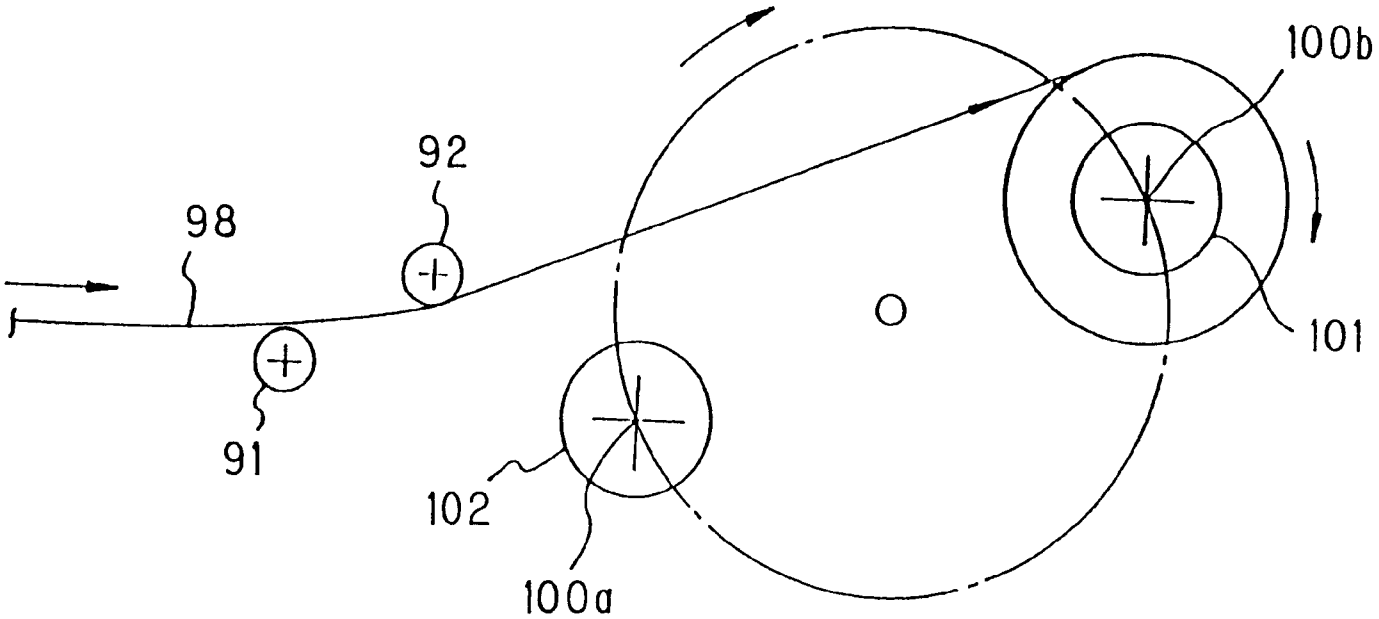
FIG. 12 is an explanation view of the operation of the deflector device subsequent to the operation of FIG. 11.
Figure 13:
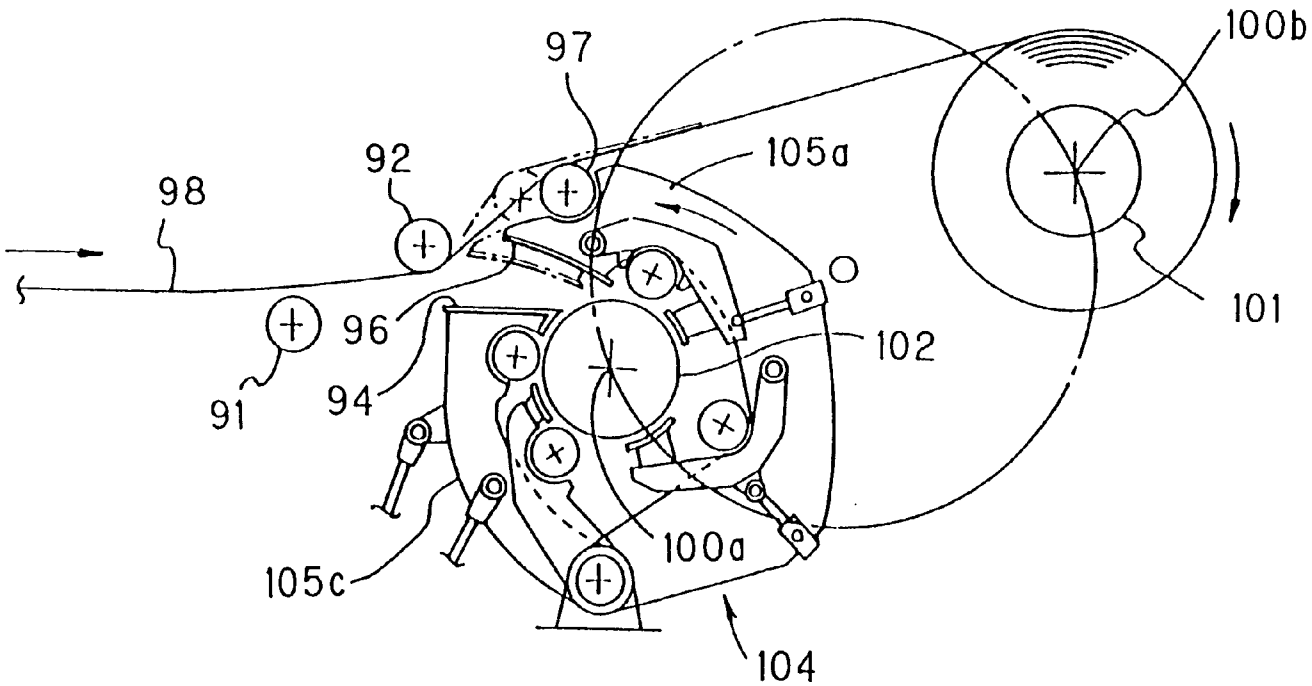
FIG. 13 is an explanation view of the operation of the deflector device subsequent to the operation of FIG. 12.
Figure 14:
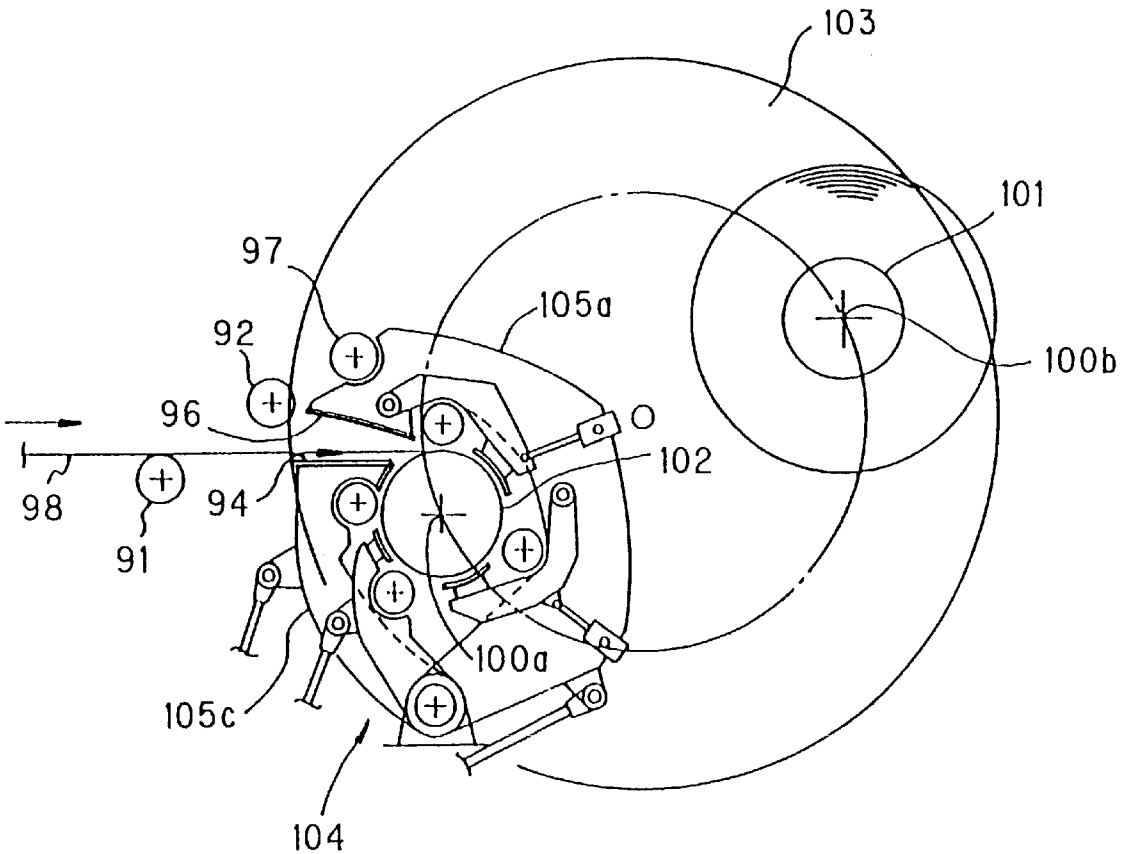
FIG. 14 is an explanation view of the operation of the deflector device subsequent to the operation of FIG. 13.

FIG. 10 is a schematic side view of a deflector device showing a sixth embodiment of the present invention. FIG. 11 is an explanation view of the operation of the deflector device. FIG. 12 is an explanation view of the operation of the deflector device subsequent to the operation of FIG. 11. FIG. 13 is an explanation view of the operation of the deflector device subsequent to the operation of FIG. 12. FIG. 14 is an explanation view of the operation of the deflector device subsequent to the operation of FIG. 13.

As shown in FIG. 10, a large frame 105*a* of a wrapping device 104 according to the present embodiment is extended as follows: When unit rolls 106*a*, 106*b* (see FIG. 11) of the large frame 105*a* are stopped with a predetermined spacing from and around a mandrel 101 or 102 at a winding start position 100*a* (i.e., in the operating state), a front end of the large frame 105*a* is located nearer to an upper deflector roll 92 than in the case of the large frame 105*a* of the preceding embodiment.

At the front end of the large frame 105*a*, upper guide means 96 is provided. The upper guide means 96 is constituted such that a horizontal spacing $w_2$ between its front end and the upper deflector roll 92 is set to be smaller than the horizontal spacing $w_1$ between the upper deflector roll 92 and the upper guide means 95 in the preceding embodiment so that it will be slightly greater than the thickness, t, of a band plate 98 (i.e., t+several millimeters). Besides, the front end of its downward guide surface 96*a* is positioned at a height, $h_2$, greater than the height $h_1$ in the preceding embodiment.

Above the upper guide means 96 at the front end of the large frame 105*a*, an auxiliary deflector roll 97 is provided rotatably. The auxiliary deflector roll 97 is held at such a position that its center makes a predetermined deflection angle $\alpha$ (e.g., 60°) for upward deflection from the center of the upper deflector roll 92, in a state in which the unit rolls 106*a*, 106*b* of the large frame 105*a* are stopped with a predetermined spacing from and around the mandrel 101 or 102 at the winding start position 100*a* (i.e., in the operating state).

That is, the auxiliary deflector roll 97 is disposed so as to be movable forward and backward integrally with the upper guide means 96, and increases the angle of deflection of the band plate 98 from the upper deflector roll 92.

The above-mentioned lower deflector roll 91, upper deflector roll 92, entrance guide means 93, lower guide means 94, upper guide means 96, and auxiliary deflector roll 97 together constitute a deflector device 90 according to the present embodiment. The other constitutions are the same as in the first embodiment, and a detailed explanation for them will be omitted by reference to the first embodiment.

According to such a deflector device 90, as explained earlier, the horizontal spacing $w_2$ between the front end of the upper guide means 96 and the upper deflector roll 92 is set to be slightly greater than the thickness, t, of the band plate 98 (i.e., t+several millimeters), and the front end of the downward guide surface 96*a* of the upper guide means 96 is positioned at the height $h_2$ which is larger than the aforementioned height $h_1$. Thus, as shown in FIG. 10, even if the front end of the band plate 98 being fed at a high speed from the rolling equipment warps upward, it becomes more difficult, than in the aforementioned embodiment, for this front end to enter the horizontal spacing $w_2$ between the front end of the upper guide means 96 and the upper deflector roll 92. Instead, the front end can be positioned more reliably below the downward guide surface 96*a* of the upper guide means 96. Consequently, the front end of the band plate 98 can be guided further reliably to the wrapping entrance of the mandrel 101 or 102 at the winding start position 100*a*.

Once the band plate 98 begins to be wound by the mandrel 101, a wrapping device 104 is retreated as shown in FIG. 11. With the mandrel 101 being driven to wind the band plate 98, a circular support frame 103 (see FIG. 14) is turned to move the mandrel 101 to a winding completion position 100*b* (see FIG. 12). At the same time, an empty mandrel 102 at the winding completion position 100*b* is moved to the winding start position 100*a*. As shown in FIG. 12, the band plate 98 is wound onto the mandrel 101 while being caused to run in a deflected manner in an upwardly inclined direction under the action of the upper deflector roll 92. As shown in FIG. 13, on the other hand, the wrapping device 104 is advanced to the original operating position, and set again. In this condition, the auxiliary deflector roll 97 of the deflector device 90 contacts a lower surface of the band plate 98 being wound, pushing the band plate 98 upward. Thus, the band plate 98 is deflected so that the large frame 105*a* and the upper guide means 96 do not impede the travel of the band plate 98.

Then, upon sensing of a predetermined winding length of the band plate 98 on the mandrel 101 at the winding completion position 10*b*, the band plate 98 is cut with a cutter (shear) which is not shown. A preceding band plate 98 is wound onto the mandrel 101 at the winding completion position 10*b*, while the front end of a succeeding band plate 98 is guided by the deflector device 90 to a wrapping entrance of the mandrel 102 at the winding start position 100*a*, and wound onto the mandrel 102 (see FIG. 14). Subsequently, the same action as above is repeated.

As stated earlier, the horizontal spacing $w_2$ between the front end of the upper guide means 96 and the upper deflector roll 92 is set to be slightly greater than the thickness, t, of the band plate 98 (i.e., t+several millimeters), and the front end of the downward guide surface 96*a* of the upper guide means 96 is positioned at the height $h_2$ which is greater than the aforementioned height $h_1$. In so setting, the auxiliary deflector roll 97 is provided so that the large frame 105*a* and the upper guide means 96 do not impede the travel of the band plate 98. By this measure, the angle of deflection of the band plate 98 from the upper deflector roll 92 is increased.

According to the above deflector device 90, therefore, even if the front end of the band plate 98 warps upward, the front end of the band plate 98 can be guided more reliably, than in the aforementioned embodiment, to the wrapping entrance of the mandrel 101 or 102 at the winding start position 100*a*. Hence, the band plate 98 can be continuously wound more reliably.

[Seventh Embodiment]

Figure 15:
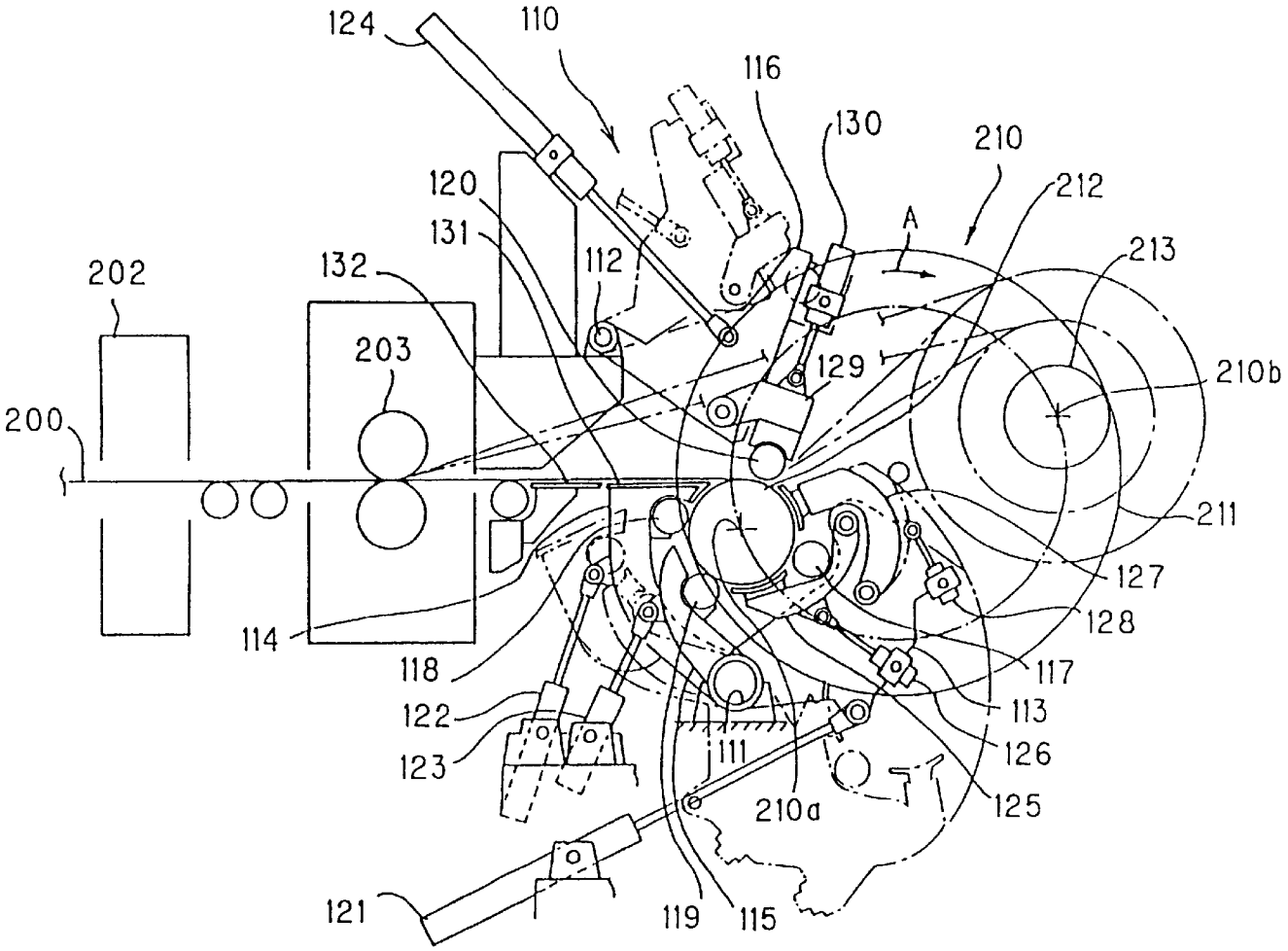
FIG. 15 is a schematic side view of a band plate winding system showing a seventh embodiment of the present invention.

FIG. 15 is a schematic side view of a band plate winding system showing a seventh embodiment of the present invention.

In FIG. 15, the reference numeral 110 denotes a roll type wrapping device disposed in combination with a carrousel type winder 210. The wrapping device 110 comprises a pair of arcuate lower large frames 113, a pair of arcuate lower medium frames 114 and a pair of arcuate lower small frames 115 having one end pivotably supported on a support shaft 111 so as to be movable toward and away from a mandrel 212 at a winding start position 210*a* below a pass line of a band plate 200; an upper frame 116 having one end pivotably supported on a support shaft 112 so as to be movable toward and away from the mandrel 212 at the winding start position 210*a* above the pass line of the band plate 200; a unit roll 117, a unit roll 118, a unit roll 119 and a unit roll 120 supported on the frames 113 to 116, respectively; cylinders 121 to 124 for moving the frames 113 to 116 back and forth about the support shafts 111 and 112, namely, for moving the frames 113 to 116 to an operating position indicated by a solid line and a retracted position indicated by a chain line; an arm 125 pivotably supported by the lower large frame 113 to pivotably support the unit roll 117; a small cylinder 126 for pivoting the arm 125 to finely adjust the position of the unit roll 117; a wrapping guide arm 127 pivotably supported by a front end side of the lower large frame 113; a small cylinder 128 for pivoting the wrapping guide arm 127 to finely adjust its position; an arm 129 pivotably supported by the upper frame 116 to pivotably support the unit roll 120; and a small cylinder 130 for pivoting the arm 129 to finely adjust the position of the unit roll 120.

At a front end of the lower medium frame 114, lower guide means 131 is provided. At a band plate 200 entry side of the lower guide means 131, entrance guide means 132 is independently disposed. According to the present embodiment, the wrapping guide arm 127, small cylinder 128, etc. constitute winding guide means.

The band plate 200 winding action of the carrousel type winder 210 combined with the roll type wrapping device 110 is described below.

The frames 113 to 116 and unit rolls 117 to 120 of the wrapping device 110 are each set at a solid line position opposed to the mandrel 212 of the winder 210. Then, when the band plate 200 is fed from rolling equipment, the mandrel 212 and the unit rolls 117 to 120 are driven and rotated in a winding direction to wind the band plate 200 around the mandrel 212.

Along with the winding of the band plate 200 around the mandrel 212, the frames 113 to 116 move to positions outside a locus of revolution of the mandrel 212 (i.e., to positions indicated by chain lines) according to the turning of a circular support frame 211. In accordance with the turning of the circular support frame 211 in a direction of an arrow A, the mandrel 212 moves to a winding completion position 210*b* while being driven to perform winding. During this action, an empty mandrel 213 at the winding completion position 210*b* moves to the winding start position 210*a*.

At this time, the upper frame 116 moves to an upper retracted position (indicated by a chain line). The band plate 200 from the rolling equipment is deflected in an upwardly inclined manner at a pinch roll 203, and wound round the mandrel 212 at the winding completion position 210*b*.

Then, the frames 113 to 116 are each set again at the original operating position (indicated by a solid line) opposed to the mandrel 213. Simultaneously, the unit roll 120 on the upper frame 116 contacts an upper surface of the band plate 200, and is set at the original operating position (indicated by a solid line) while pushing the band plate 200 downward.

Upon sensing of a predetermined winding length of the band plate 200, the band plate 200 is cut with a cutter 202. A preceding band plate 200 is wound onto the mandrel 212 at the winding completion position 210*b*. Whereas the small cylinder 128 of the wrapping guide arm 127 and the small cylinder 130 of the arm 129 are actuated synchronously, whereupon the unit roll 120 and the wrapping guide arm 127 act cooperatively, thereby winding a succeeding band plate 200 round the mandrel 213.

That is, the unit roll 120 on the upper frame 116 enables the band plate 200 to be deflected in an upwardly inclined direction, and also the band plate 200 to be directed in a different direction.

Thus, even when the band plate 200 is wound round the mandrel 212 of the winder 210, while the wrapping device 110 is reset around the other empty mandrel 213, the band plate 200 is no more damaged. Besides, it becomes possible to wind the rear end of the preceding band plate 200 on the winding completion position 210*b* side, and the front end of the succeeding band plate 200 on the winding start position 210*a* side, reliably in a divided manner.

Furthermore, the unit roll 120 to be located at the upper winding entrance of the mandrel 213 is supported by the upper frame 116. Thus, the length of the lower large frame 113 can be shortened, so that the range of movement of the lower large frame 113 during retraction can be decreased. Hence, the diameter of revolution of the mandrel 212 or 213 according to the turn of the circular support frame 211 can also be decreased, so that the diameter of the circular support frame 211 can be reduced.

If the maximum diameter of a coil taken up by the mandrel 212 or 213 is a constant value of 2.1 m, for example, the diameter of revolution of the mandrel 212 or 213 according to the turn of the circular support frame 211 needs to be set at about 2.7 m in the case of the conventional system. According to the present embodiment, on the other hand, the diameter of revolution of the mandrel 212 or 213 according to the turn of the circular support frame 211 may be about 2.3 m. Thus, the circular support frame 211 of the carrousel type winder 210 can be reduced by about 15% compared with the conventional system.

[Eighth Embodiment]

Figure 16:
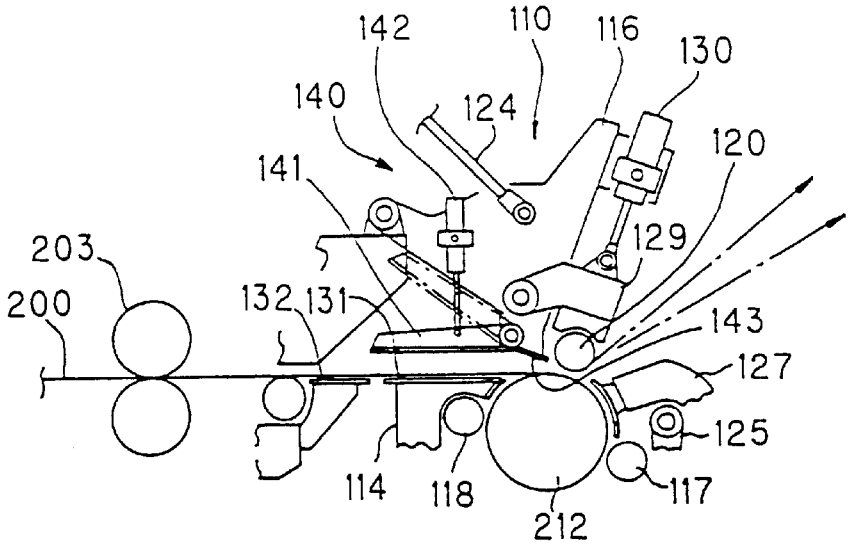
FIG. 16 is a side view of an essential part of a band plate winding system showing an eighth embodiment of the present invention.

FIG. 16 is a side view of an essential part of a band plate winding system showing an eighth embodiment of the present invention.

As shown in FIG. 16, first guide means 140 for guiding a front end of a band plate 200 from rolling equipment to a wrapping entrance of a mandrel 212 or 213 is provided at a front end portion of the upper frame 116 indicated in the preceding embodiment.

The first guide means 140 comprises a moving guide plate 141 having one end attached pivotably to a front end of the upper frame 116 and extending toward the rolling equipment; a tilting small cylinder 142 connected by a shaft between the other end side of the moving guide plate 141 and the upper frame 116; and a fixed guide plate 143 fixed to the upper frame 116 in a manner continued from a base end of the moving guide plate 141.

With the above-described wrapping device, the band plate 200 can be reliably guided to the mandrel 212 by the moving guide plate 141 and fixed guide plate 143 of the first guide means 140. Furthermore, the small cylinder 142 is actuated to lift the moving guide plate 141 (to a chain line position in FIG. 16) and move the upper frame 116 to a retracted position. By so doing, the first guide means 140 can be held at a position at which it does not impede the movement of the band plate 200 from a pinch roller 203 toward the mandrel 212 at a winding completion position 210*b*. When the mandrel 212 has moved to the winding completion position 210*b*, therefore, the first guide means 140 does not contact the band plate 200 being wound, and damage to the band plate 200 can be prevented.

The upper frame 116 is pushed outward to an operating position (indicated by a solid line) to guide a front end of a cut band plate 200 toward the mandrel 213 located at a winding start position 210*a*. At this time, the moving guide plate 141 is brought to a suitable inclined or parallel posture relative to a pass line of the band plate 200. By this measure, the front end of the band plate 200 can be guided reliably to a wrapping entrance of the mandrel 213.

[Ninth Embodiment]

Figure 17:
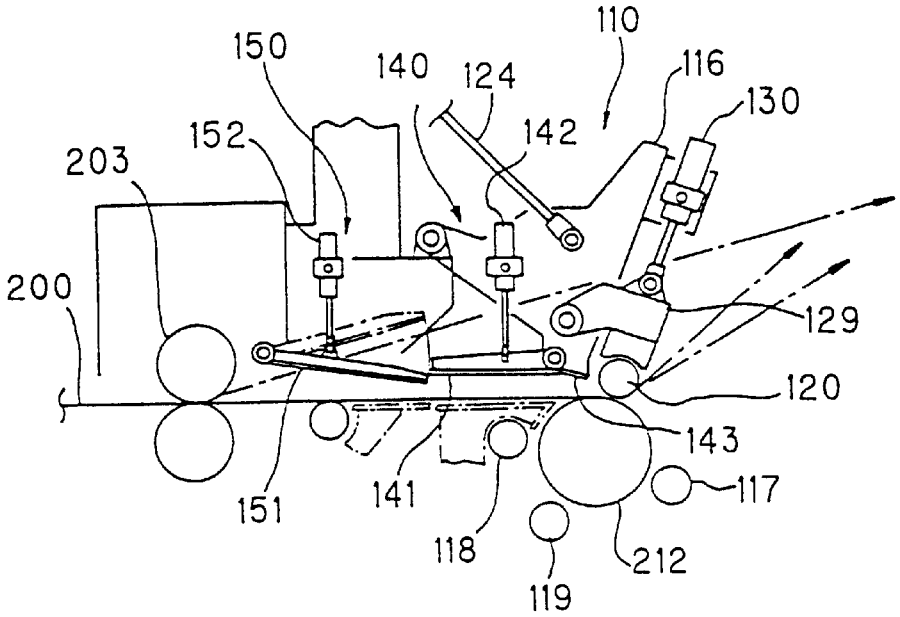
FIG. 17 is a side view of an essential part of a band plate winding system showing a ninth embodiment of the present invention.

FIG. 17 is a side view of an essential part of a band plate winding system showing a ninth embodiment of the present invention.

As shown in FIG. 17, second guide means 150 opposed from above to a pass line of a band plate 200 is pivotably disposed on an entry side of the first guide means 140 in the preceding embodiment, i.e., between a rolling equipment side and the first guide means 140, so as to be continued from the first guide means 140.

The second guide means 150 comprises a moving guide plate 151 which has one end attached upwardly and downwardly pivotably to a stand or the like of a pinch roll 203 above an upwardly inclined pass line of the band plate 200 heading from the pinch roll 203 toward a mandrel 213 at a winding completion position 210*b*, and which extends to a position close to or overlapping an entry-side end of the first guide means 140; and a tilting small cylinder 152 connected by a shaft between the other end side of the moving guide plate 151 and an upper fixed structure.

With the above-described wrapping device, the band plate 200 can be further reliably guided to a mandrel 212 by the first guide means 140 and the second guide means 150. Besides, a small cylinder 142 of the first guide means 140 is actuated to lift a moving guide plate 141 and move an upper frame 116 to a retracted position. Then, the small cylinder 152 of the second guide means 150 is actuated to lift the moving guide plate 151 for a constant stroke in an inclined manner. By so doing, the guide means 140 and 150 can be held at positions at which they do not impede the movement of the band plate 200 from the pinch roller 203 toward the mandrel 212 at the winding completion position 210*b*. When the mandrel 212 has moved to the winding completion position 210*b*, therefore, the guide means 140 and 150 do not contact the band plate 200 being wound, and damage to the band plate 200 can be prevented.

When the moving guide plate 151 of the second guide means 150 is moved downward, the front end of the moving guide plate 151 is positioned below the front end of the moving guide plate 141 of the first guide means 140. By this measure, the front end of a cut band plate 200 can be guided to a wrapping entrance of the mandrel 213 further reliably and safely.

[Tenth Embodiment]

Figure 18:
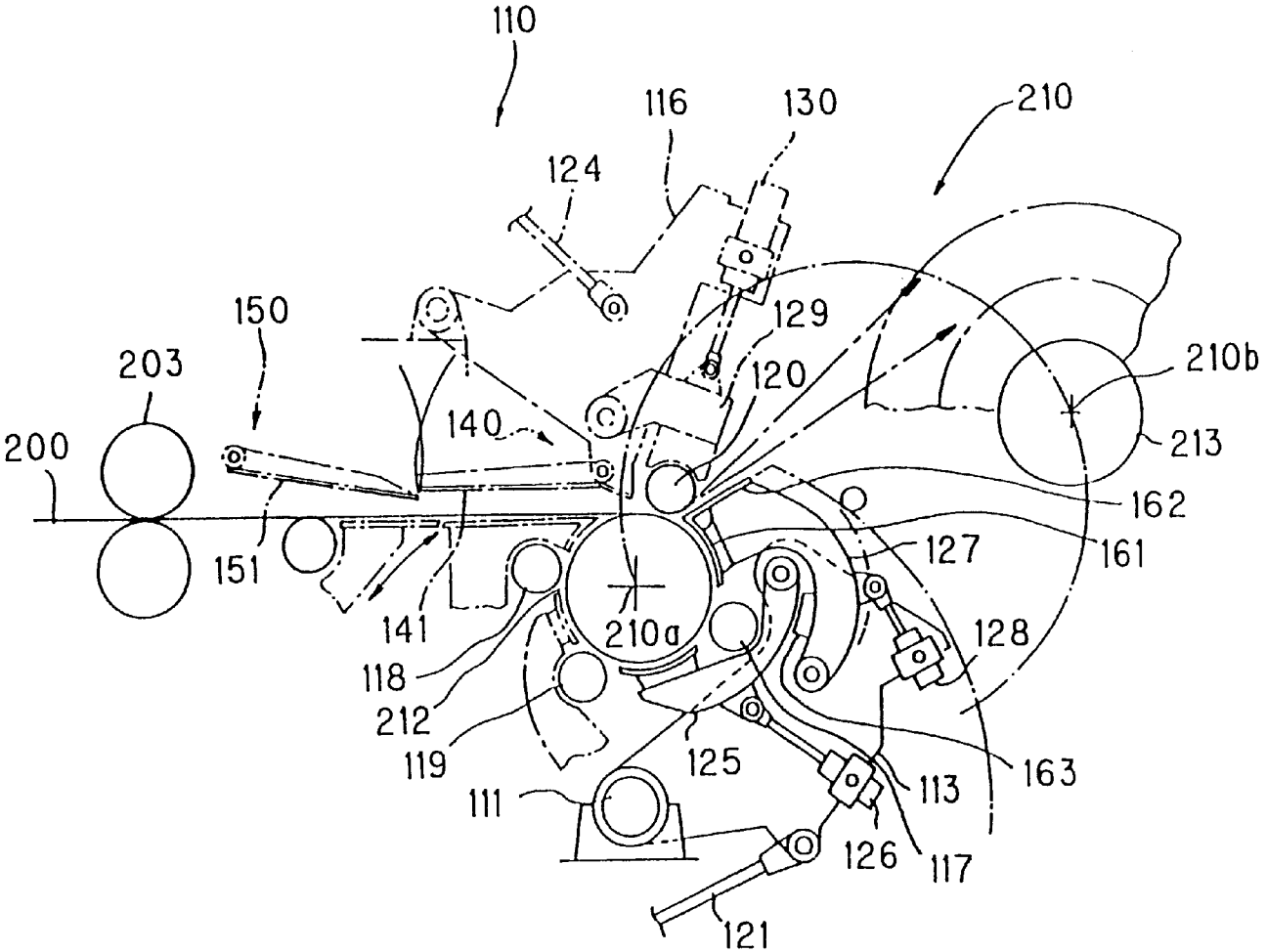
FIG. 18 is a side view of an essential part of a band plate winding system showing a tenth embodiment of the present invention.

FIG. 18 is a side view of an essential part of a band plate winding system showing a tenth embodiment of the present invention.

As shown in FIG. 18, at a front end of the wrapping guide arm 127 in the previous embodiment, there are provided a wrapping guide plate 161 facing a mandrel 212 or 213, and a deflecting guide plate 162 facing a band plate 200 which deflects in an upwardly inclined direction at a unit roll 120 of an upper frame 116 set at an operating position. At a portion of the wrapping guide arm 127 which faces an arm 125, a safety plate 163, as interlocking means, is provided so as to face the arm 125 with a slight gap present between the safety plate 163 and the arm 125.

With the above-described wrapping device, there may be a case in which after the front end of the band plate 200 passes along the wrapping guide plate 161, a small cylinder 128 does not work for an unexpected reason when it is attempted to move the wrapping guide arm 127 backward by driving the small cylinder 128. Even in this case, as the arm 125 recedes by the action of the small cylinder 126, the safety plate 163 is pushed by the arm 125 to move the wrapping guide arm 127 backward. That is, the wrapping guide arm 127 recedes in association with the backward movement of the unit roll 120 of the upper frame 116.

Hence, even if the small cylinder 128 does not act for an unexpected reason when its driving is to move the wrapping guide arm 127, the front end of the band plate 200 can be prevented from jamming between the wrapping guide plate 161 and the mandrel 213.

[Eleventh Embodiment]

Figure 19:
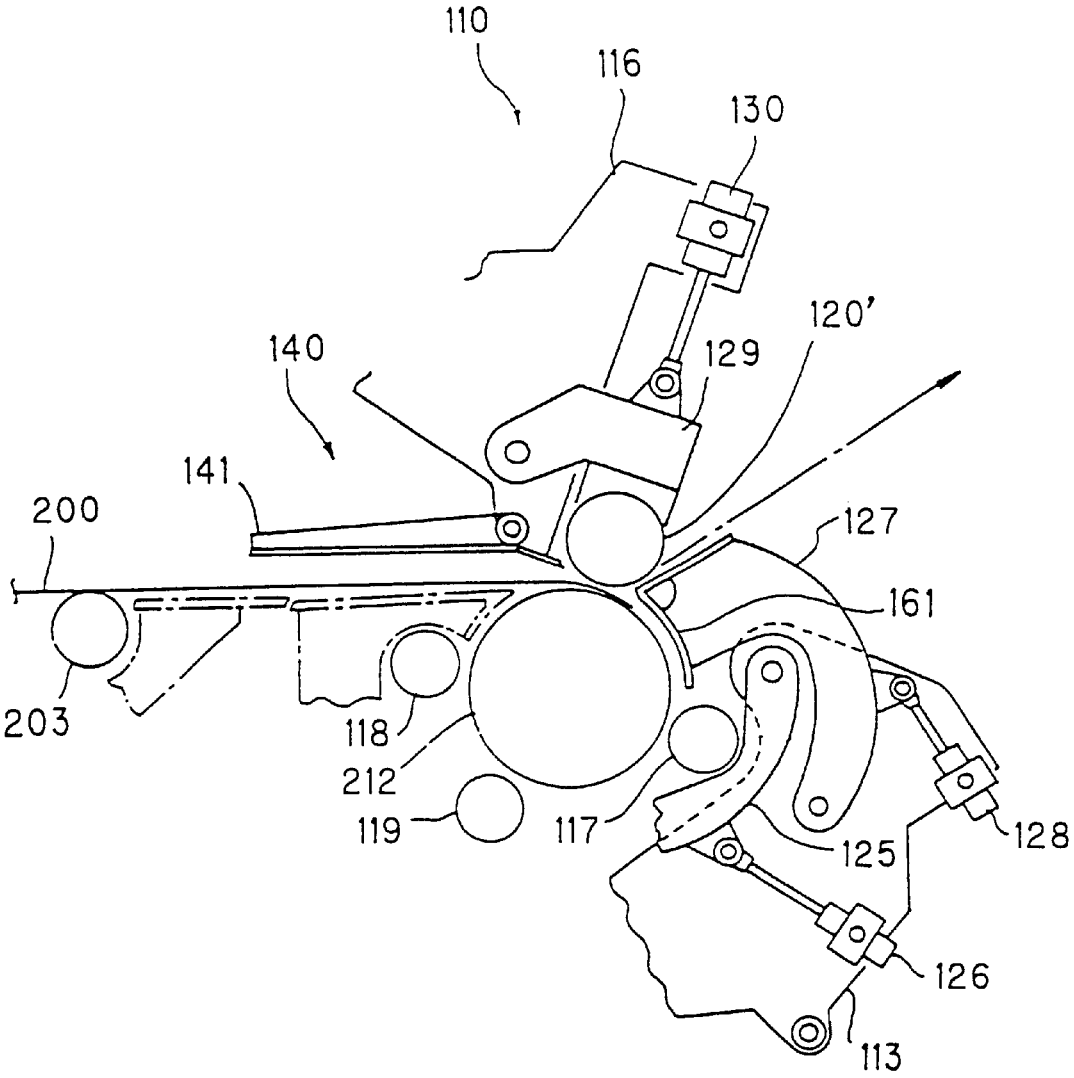
FIG. 19 is a side view of an essential part of a band plate winding system showing an eleventh embodiment of the present invention.

FIG. 19 is a side view of an essential part of a band plate winding system showing an eleventh embodiment of the present invention.

As shown in FIG. 19, a unit roll 120' of the upper frame 116 in the previous embodiment is larger in diameter than other unit rolls 117 to 119.

Thus, a band plate 200 contacts a mandrel 212 or 213 at the first entrance on a large roll curved surface of the unit roll 120', so that the front end of the band plate 200 can be drawn in more reliably, than in the case of the unit roll 120 used in the previous embodiment, along an outer peripheral surface of the mandrel 212 or 213. Moreover, the front end of the band plate 200 can be reliably brought upward or downward in an assorted manner.

Furthermore, even when the gap between a wrapping guide plate 161 of a wrapping guide arm 127 and the mandrel 212 or 213 is rendered large, the front end of the band plate 200 can be reliably brought upward or downward in an assorted manner. Hence, jamming of the front end of the band plate 200 can be prevented further reliably.

[Twelfth Embodiment]

Figure 20:
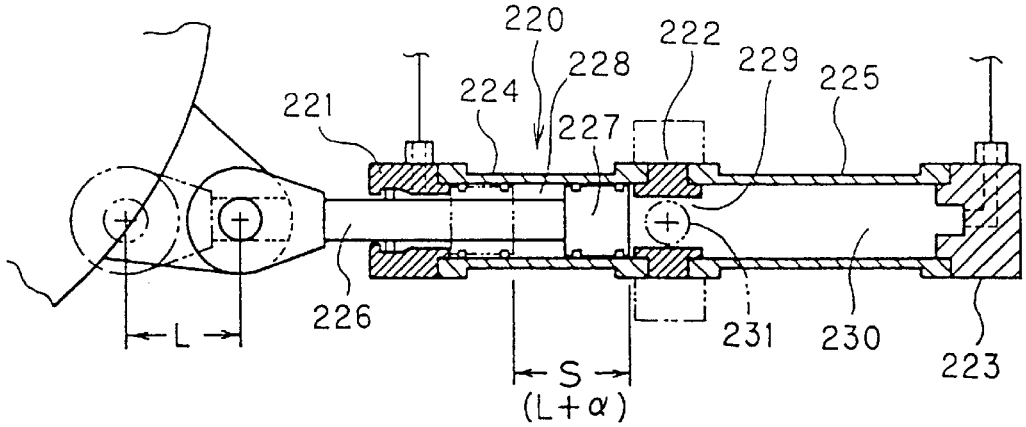
FIG. 20 is a sectional view of a small cylinder for a unit roll support arm showing a twelfth embodiment of the present invention.
Figure 21:
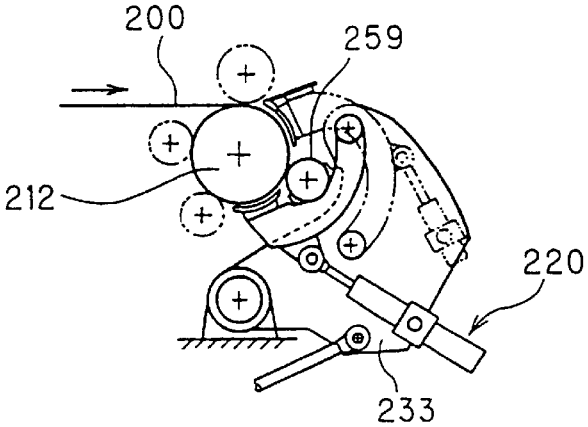
FIG. 21 is a side view showing a state of mounting of the small cylinder.

FIG. 20 is a sectional view of a small cylinder for a unit roll support arm showing a twelfth embodiment of the present invention. FIG. 21 is a side view showing a state of mounting of the small cylinder.

In FIG. 20, the reference numeral 220 denotes a small cylinder for backing up a unit roll 259 shown in the tenth and eleventh embodiments.

The small cylinder 220 is composed of a rod-side cylinder cover 221, an intermediate cover 222, a head-side cover 223, and two cylinder barrels 224, 225 provided in series between these covers. The reference numeral 226 denotes a rod. The reference numeral 227 denotes a piston. The reference numeral 228 denotes a piston stroke oil chamber inside the cylinder barrel 224. The reference numeral 229 denotes a through-hole inside the intermediate cover 222. The reference numeral 230 denotes a head-side cushioning oil chamber formed in the cylinder barrel 225 so as to communicate with the piston stroke oil chamber 228 via the through-hole 229. The reference numeral 231 denotes a longitudinal shaft for support of the small cylinder 220 on a large frame.

The stroke length, S, of the piston stroke oil chamber 228 is the same as the length in the conventional system that is the sum of a necessary forward or backward movement amount, L, of the unit roll 259 during winding of a band plate and an allowance $\alpha$. The head-side cushioning oil chamber 230 has a length over which to contain an amount of a pressure oil enough to cushion maximum impact force that the unit roll 259 undergoes from a band plate 200 side.

FIG. 21 shows a case in which the small cylinder 220 produced on an actual machine basis with the above-mentioned constitution is applied onto a lower large frame 233 of the roll type wrapping device in the tenth and eleventh embodiments.

The small cylinder 220 of the above-mentioned constitution can be used in place of the small cylinder **24*b* in the wrapping device of the first embodiment. In either case, the small cylinder 220** can be mounted on the large frame whose shape is unchanged or slightly changed.

Provision of the intermediate cover 222 between the piston stroke oil chamber 228 and the impact force cushioning oil chamber 230 cab reinforce the intermediate portion of the elongated cylinder 220. Thus, the cylinder 220 can be mounted on the lower large frame safely at the intermediate cover 222.

According to this constitution, the pressure oil chamber containing an amount of a pressure oil capable of cushioning maximum impact force imposed on the unit roll 259 is provided on the head side of the piston rod of the small cylinder 220. Thus, all impact forces, high and low, which are imposed on the unit roll 259 on the lower large frame from the band plate 200 side during winding of the band plate 200 onto the mandrel 212 can be absorbed and cushioned by the backup small cylinder 220 always safely. Hence, failure of the system and occurrence of a defective product due to impact force during band plate winding can be dissolved, and productivity increased.

[Thirteenth Embodiment]

Figure 22:
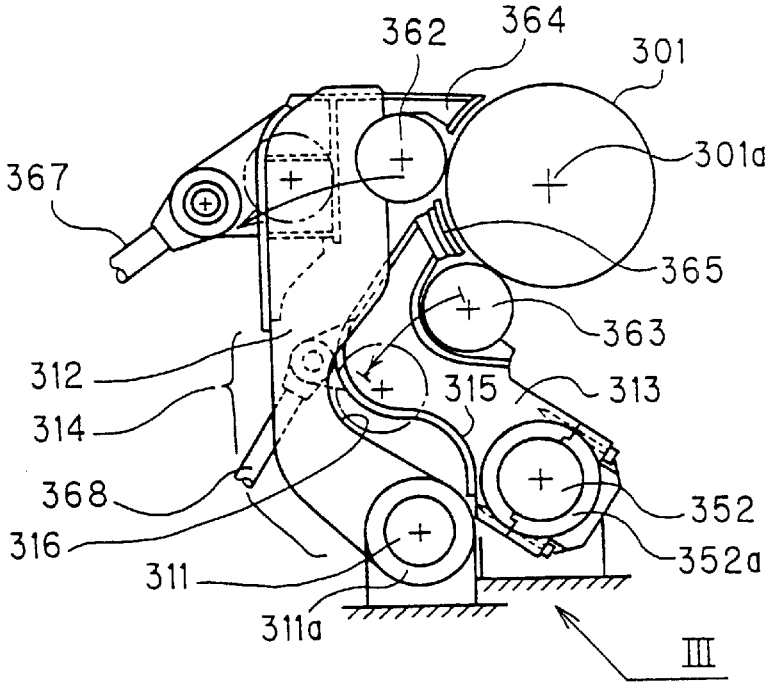
FIG. 22 is a side view of two frame portions on an upstream side of a rolling equipment line showing a thirteenth embodiment of the present invention.
Figure 23:
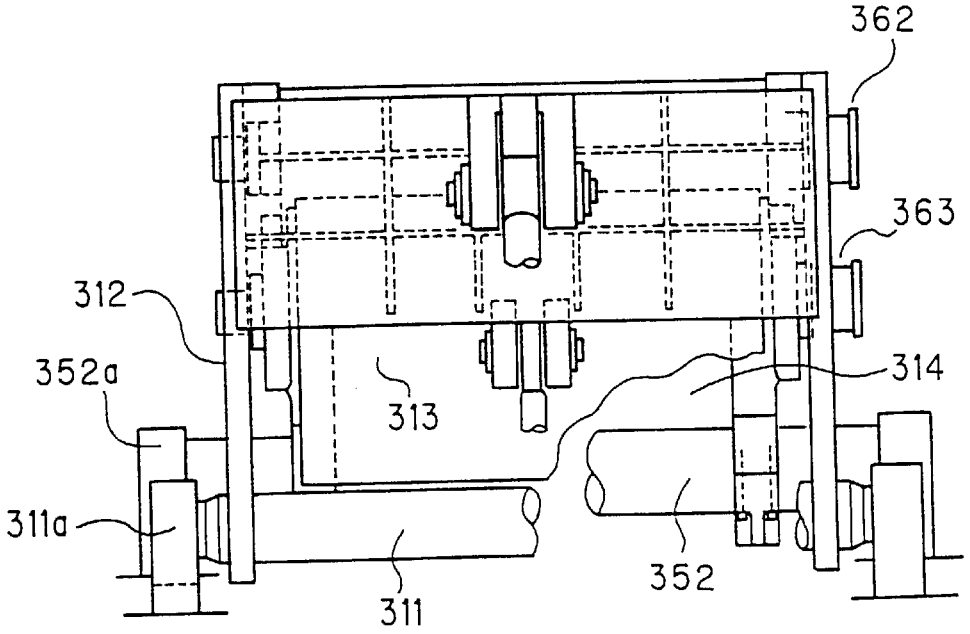
FIG. 23 is a front view of the frame portions in FIG. 22.
Figure 24:
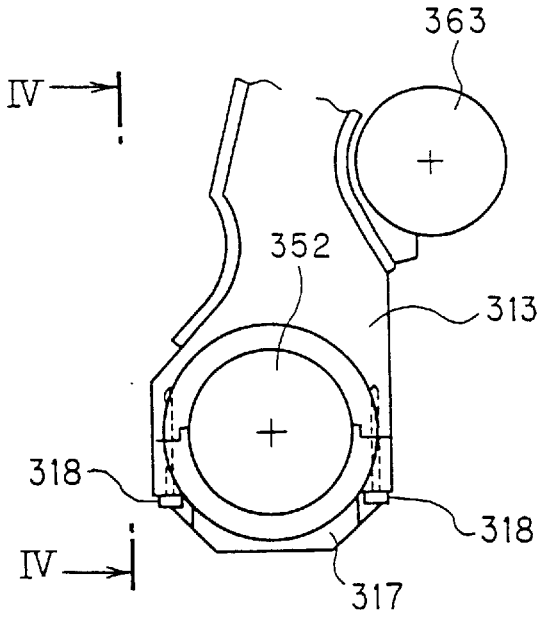
FIG. 24 is an enlarged side view of the III portion in FIG. 22.
Figure 25:
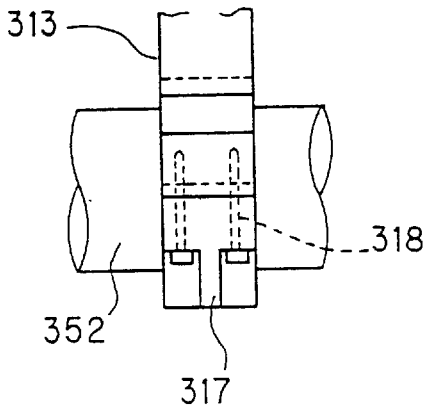
FIG. 25 is a front view taken on line IV—IV of FIG. 24.
Figure 26:
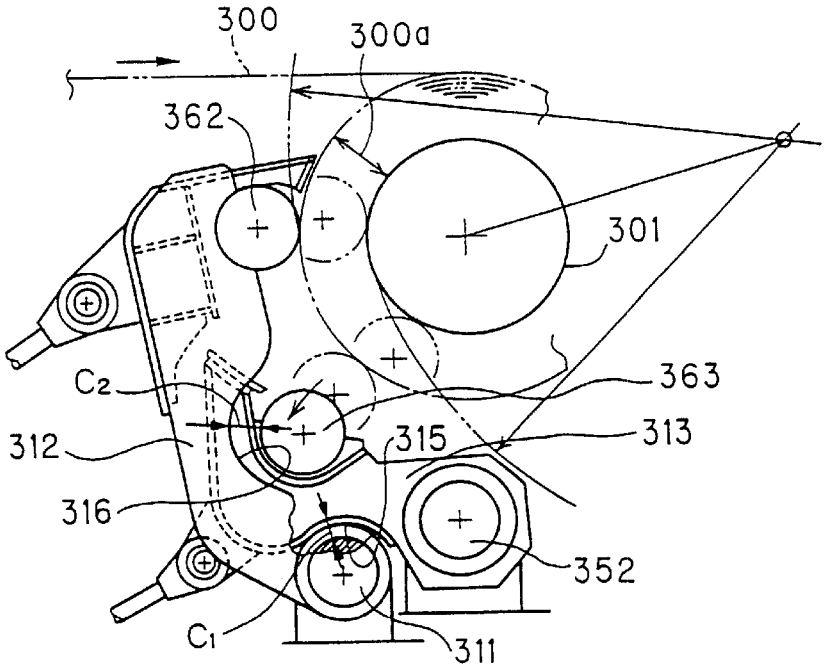
FIG. 26 is an explanation view of the operation of the frame portions in FIG. 22.
Figure 27:
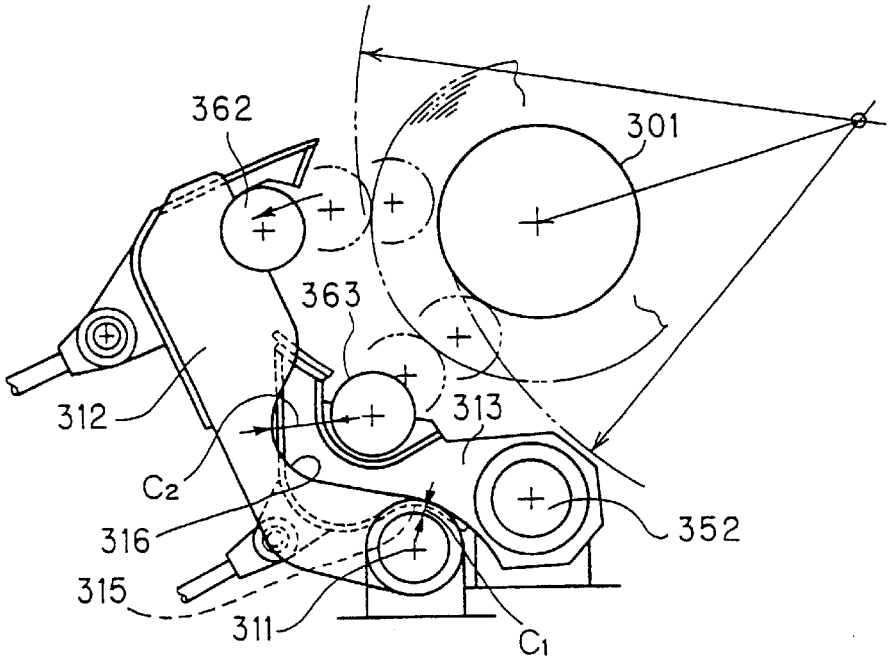
FIG. 27 is another explanation view of the operation of the frame portions in FIG. 22.

FIG. 22 is a side view of two frame portions on an upstream side of a rolling equipment line showing a thirteenth embodiment of the present invention. FIG. 23 is a front view of the frame portions in FIG. 22. FIG. 24 is an enlarged side view of the III portion in FIG. 22. FIG. 25 is a front view taken on line IV—IV of FIG. 24. FIG. 26 is an explanation view of the operation of the frame portions in FIG. 22. FIG. 27 is another explanation view of the operation of the frame portions in FIG. 22.

In FIG. 22, the reference numeral 301 denotes a mandrel resting statically at the winding start position **301*a* in the tenth and eleventh embodiments. The reference numerals 362, 363 denote two (i.e., upper and lower) rolls facing a side surface, on a rolling line upstream side, of the mandrel 301. The reference numeral 352 denotes a support shaft shared by a large frame 113 (see FIG. 18) below the mandrel 301. The reference numeral 311 denotes a support shaft additionally provided on a rolling line upstream side of the support shaft 352. The reference numeral 312 denotes a frame for supporting the unit roll 362, the frame having a lower end pivotably supported by the support shaft 311. The reference numeral 313 denotes a frame for supporting the unit roll 363, the frame having a lower end pivotably supported by the support shaft 352. The support shaft 352 is fixedly supported by a bearing 352*a*, while the support shaft 311 is rotatably provided on a bearing 311*a*** via a bearing.

The support frame 312 is provided externally so as to be pivotable by having an upper central rear portion connected to a rod end of a cylinder 367. The support frame 313 is provided internally so as to be pivotable by having an upper central rear portion connected to a rod end of a cylinder 368 which passes through an opening portion 314 of the support frame 312, as shown in FIGS. 22 and 23.

In the internal support frame 313, lower rear surface portions of both side plates thereof which support the unit roll 363 and a band plate wrapping guide member 365 are each a concave curved surface portion 315 in a panel-like form so as not to interfere with the support shaft 311 at an adjacent position during retreating movement.

In the external support frame 312, upper portions of both side plates which support the unit roll 362 and a band plate wrapping guide member 364 are each shaped like a panel. In a lower portion between both side plates, the opening portion 314 is formed. An upper half of the support frame 313 can come in and go out of the opening portion 314.

At an inner edge portion of both side plates of the external support frame 312, a concave curved surface portion 316 is formed. The concave curved surface portion 316 is designed such that when the internal support frame 313 is moved to a set retreat position with the external support frame 312 being set at a band plate winding position, the external support frame 312 does not contact or interfere with the unit roll 363 of the internal support frame 313.

In FIGS. 24 and 25, a shaft-attached portion at a lower end of the internal support frame 313 is constituted such that a boss portion fitted onto an outer surface of a bearing on the support shaft 352 has a semi-arcuate split piece 317. The semi-arcuate split piece 317 is joined to the boss portion on the frame 313 body side by screws 318 while sandwiching the bearing on the support shaft 352, whereby the frame 313 can be fixed detachably to the support shaft 352.

FIG. 26 shows a state in which after the aforementioned two pivotable frames 312 and 313 upstream of the mandrel are set in the band plate winding position, only the internal pivotable frame 313 is moved to the set retreat position.

When a band plate 300 begins to be wound, and is piled up on the mandrel 301, the unit rolls 362, 363 pressing the surface of the band plate 300 against the mandrel 301 at a constant oil pressure are pushed back as the diameter of the band plate increases. The band plate 300 piled on the mandrel 301 reaches a set coil diameter (thickness) 300*a*, all the unit rolls including the unit rolls 362, 363 are separated from the band plate surface, and moved to a predetermined retreat position.

FIG. 26 shows a case in which while the unit roll 362 of the external frame 312 is in contact with the coil surface, the unit roll 363 of the internal frame 313 precedes, and moves to the retreat position.

The unit roll 363 of the internal frame 313, as shown in FIGS. 22 and 26, sets as a predetermined retreat position a position in the concave curved surface 316 of the external frame 312 held in a condition in contact with the coil surface. By detecting its moving distance or the like by means of a detector, the unit roll 363 is allowed to move to the retreat position without contacting the external frame 312.

In the state of FIG. 26, at this time, clearances $C_1$, $C_2$ in agreement with the pivoting distance of the external frame 312 corresponding to the coil thickness 300*a* are retained between the concave curved surface portion 315 of the internal frame 313 and the support shaft 311, and between the concave curved surface portion 316 of the external frame 312 and the unit roll 363, respectively. Of these clearances, the clearance $C_2$ is set to be kept minimal when only the external frame 312 is pivoted and returned to the wrapping position relative to the empty mandrel 301, as shown in FIG. 22.

According to the above constitution, when only the internal frame 313 is moved to the retreat position in a preceding manner, and when only the external frame 312 is returned to the wrapping position relative to the empty mandrel 301, collision and interference between the unit roll 363 on the internal frame 313 and the external frame 312 are resolved.

Next, FIG. 27 shows a case in which the external frame 312 and the internal frame 313 are synchronously moved to a retreat position. The external frame 312 sets as a retreat position a position at which the external frame 312 is apart by a certain distance, as illustrated, from the surface of the band plate wrapping thickness 300*a* on the mandrel 301. With its moving distance or the like being detected by a detector, the external frame 312 is moved to the retreat position. At this time, the internal frame 313 is moved to the same retreat position as shown in FIG. 26, and stopped there. The clearance $C_1$ between the concave curved surface portion 315 of the internal frame 313 and the support shaft 311 of the external frame 312 is kept minimal in this state.

According to the above constitution, when the external frame 312 and the internal frame 313 are synchronously moved from the retreat position in FIG. 27 to the band plate wrapping position, collision and interference between the external frame 312 and the unit roll 363 on the internal frame 313 no longer occur, even if only the external frame 312 moves to the band plate wrapping position in a preceding manner.

With both frames 312 and 313 having moved to the retreat position, the mandrel 301 during winding of the band plate 300 revolves clockwise according to the turning of the circular support frame while winding the band plate 300. In this manner, this mandrel 301 is replaced by an empty mandrel 301 located at the winding completion position.

Besides, the attachment boss portion of at least the internal frame 313 for attachment to the support frame 352 is shaped like the semi-arcuate split form 317, and is adapted to be detachably secured to the support frame 352 by the screws 318. Thus, attachment and detachment of the internal frame 313 become markedly easy for maintenance, etc.

According to the above-described embodiment, at the time of the switching movement of the two pivotable frames 312 and 313 for support of the unit rolls 362 and 363 of the mandrel 301 to the band plate wrapping position and the retreat position, collision and interference between both frames 312 and 313 are resolved. Hence, damage to the machine and interruption of operation due to their collision or interruption can be eliminated. Furthermore, a system easy to assemble and maintain can be provided.

[Fourteenth Embodiment]

Figure 28:
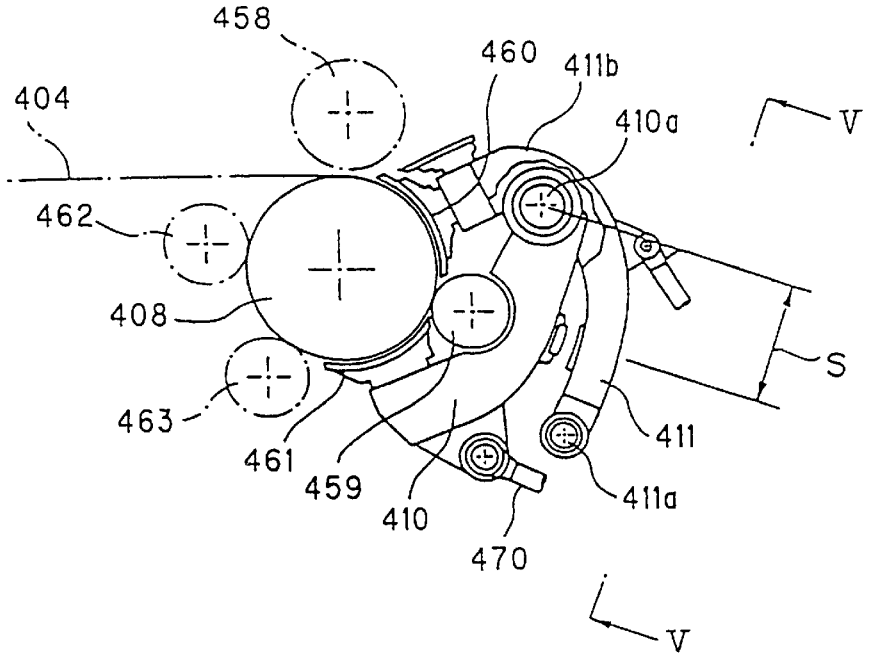
FIG. 28 is a side view of an essential part of a band plate winding system showing a fourteenth embodiment of the present invention.
Figure 29:
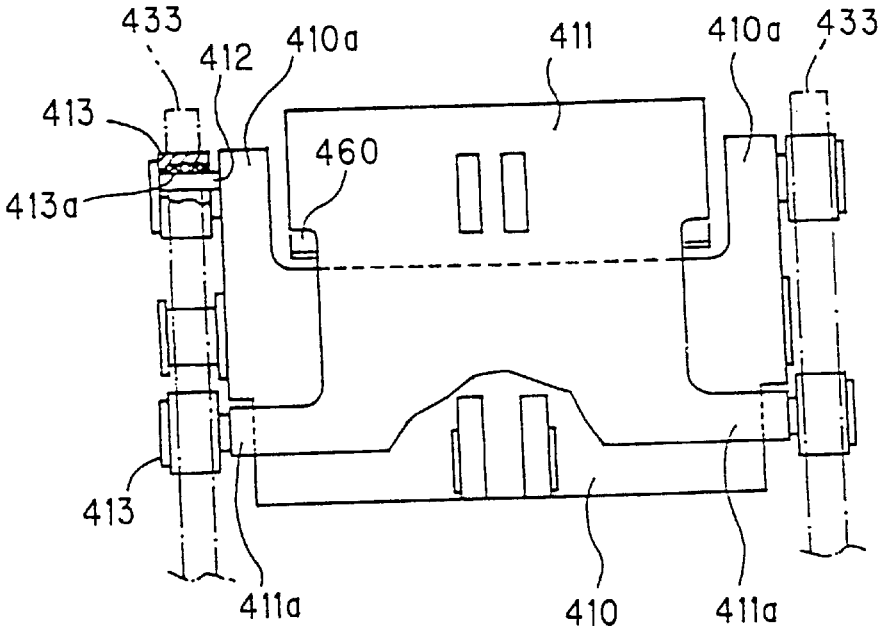
FIG. 29 is a front view taken on line V—V of FIG. 28.
Figure 30:
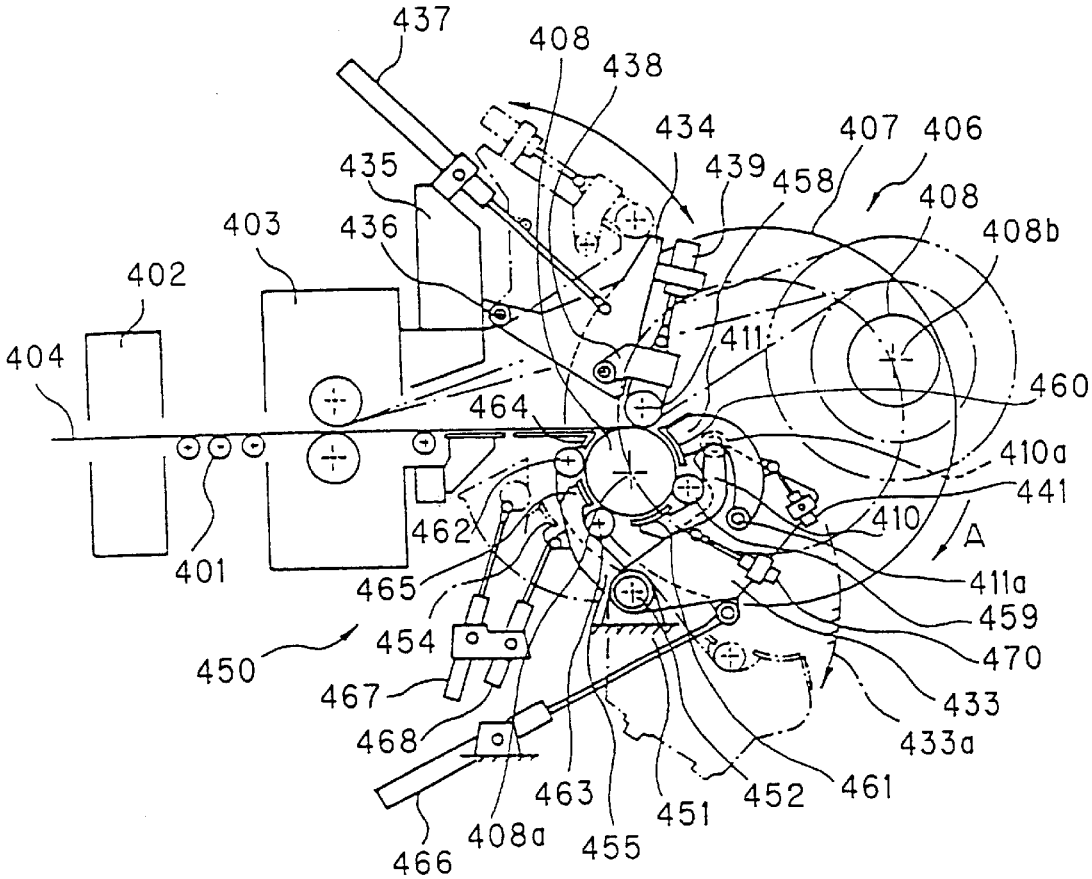
FIG. 30 is a side view of the band plate winding system in FIG. 28.

FIG. 28 is a side view of an essential part of a band plate winding system showing a fourteenth embodiment of the present invention. FIG. 29 is a front view taken on line V—V of FIG. 28. FIG. 30 is a side view of the band plate winding system in FIG. 28.

In FIGS. 28 to 30, the reference numeral 401 denotes a roller table of a rolling equipment line, 402 denotes a plate cutter on a delivery side of the line, 403 denotes a pinch roll, 404 denotes a rolled band plate, 406 denotes a carrousel type winder, and 450 denotes a roll type wrapping device placed in combination with the carrousel type winder 406. The carrousel type winder 406 and the roll type wrapping device 450 constitute a band plate winding system.

The carrousel type winder 406 is composed of a circular support frame 407 placed at a side portion on the delivery side of the line so as to be rotationally drivable, and two mandrels 408, 408 supported at symmetrical positions of the circular support frame 407 individually rotationally drivable about a horizontal axis. The reference numeral 408*a* denotes a winding start position of the mandrel 408, while the reference numeral 408*b* denotes a winding completion position of the mandrel 408.

The wrapping device 450 has a pair of arcuate piece-like lower large frames (pivoting frames) 433, a pair of arcuate piece-like medium frames (pivoting frames) 454, and a pair of arcuate piece-like small frames (pivoting frames) 455, each frame having one end supported pivotably on a support shaft 452 on a base 451. On the pair of lower large frames 433, a second panel-like arm 410 and a first panel-like arm 411 having both ends pivotably supported are mounted. On front end portions of the second panel-like arm 410 and the first panel-like arm 411, wrapping guide members 461, 460 are provided. On the second panel-like arm 410, a unit roll 459 is also provided. On the pair of medium frames 454 and the pair of small frames 455, respectively, a unit roll 462 and a unit roll 463 having both ends supported are provided, and wrapping guide members 464, 465 are also provided. To the frames 433, 454, 455, cylinders 466, 467, 468 to be moved back and forth around the support shaft 452 are connected. To the second panel-like arm 410 and the first panel-like arm 411, small cylinders 441, 470 for moving toward and away from a mandrel side on the frames 433 are connected.

An upper frame 434 has one end pivotably supported by a horizontal shaft 436 on an upper base 435, and has the other end on which a panel-like arm 438 is provided so as to be pivotable by a small cylinder 439. To an intermediate portion of the upper frame 434, a cylinder 437 is connected. Upon extension and contraction of the cylinder 437, the upper frame 434 is pivoted so as to be movable toward and away from the mandrel 408. On the panel-like arm 438, an upper-side unit roll 458 having both ends supported is independently provided.

The circular support frame 407 and the mandrels 408, 408 are moved in a direction of an arrow A, with the frames 433, 434, 454, 455 of the wrapping device 450 being open at positions shown by one-dot chain lines. In a state in which an empty mandrel 408 is stopped at a winding start position 408*a*, the unit rolls 458, 459, 462, 463 and the wrapping guide members 460, 461, 464, 465 are set, as shown by solid lines, around this mandrel 408. At this time, winding of a rolled band plate 404 is started.

After wrapping of the band plate 404 around the mandrel 408 is confirmed, the frames 433, 434, 454, 455 of the wrapping device 450 become open at the positions shown by the one-dot chain lines. In this state, the circular support frame 407 revolves in the direction of arrow A. According to this revolution, the mandrel 408 also moves along the periphery of the circular support frame 407 while winding the band plate 404. When the mandrel 408 stops at the winding completion position 408*b*, winding of the band plate 404 is finished. Then, winding of the band plate 404 around the mandrel 408 at the winding start position 408*a* is repeated by the same procedure as described above.

According to the present embodiment, as shown in FIGS. 28 and 29, the second panel-like arm 410 is composed of a U-shaped panel-like arm body, and has shaft-attached portions 410*a* at protruding ends of its U shape. The first panel-like arm 411 is composed of a roughly I-shaped panel-like arm body, and has shaft-attached portions 411*a* at its lower jutting portions. On its upper jutting portion, the wrapping guide member 460 is provided. The upper head side of the first panel-like arm 411 passes through a U-shaped space defined by the second panel-like arm 410, and faces a surface of the mandrel 408.

That is, the shaft-attached portions 410*a* of the second panel-like arm 410 are provided in a plane of projection of a head portion 411*b* of the first panel-like arm 411 at the winding start position, and the first panel-like arm 411 and the second panel-like arm 410 are constituted as above. Thus, the head side of the first panel-like arm 411 can pass between the shaft-attached portions 410*a* and 410*a* of the second panel-like arm 410, and move toward and away from the mandrel 408.

The shaft-attached portion 410*a* of the second panel-like arm 410 is supported on a fixing shaft 412 which is supported via a bearing 413*a* by a bearing 413 provided on the lower large frame 433. The shaft-attached portion 411*a* of the first panel-like arm 411 is also supported via a bearing 413*a* by a bearing 413 provided on the lower large frame 433.

According to the above constitution, the head side of the first panel-like arm 411 can freely move back and forth in the U-shaped space between the shaft-attached portions 410*a* of the second panel-like arm 410. Thus, the length, including the shaft-attached portions 410*a*, of the second panel-like arm 410 can be designed freely, without interference with the first panel-like arm 411. Also, the shaft-attached portion 410*a* of the second panel-like arm 410 can be supported on the lower large frame 433 in an outward open free space.

Thus, the center distance S between the unit roll 459 and the shaft-attached portion 410*a* of the second panel-like arm 410 can be made great. In addition, the shaft-attached portion 410*a* can be safely supported by the bearing 413, etc. on the lower large frame 433. Consequently, when a reaction force of the band plate is imposed on the unit roll 459, the second panel-like arm 410 can pivot smoothly counterclockwise, so that concentration of stress on the shaft-attached portion 410*a* and damage thereto are resolved.

[Fifteenth Embodiment]

Figure 31:
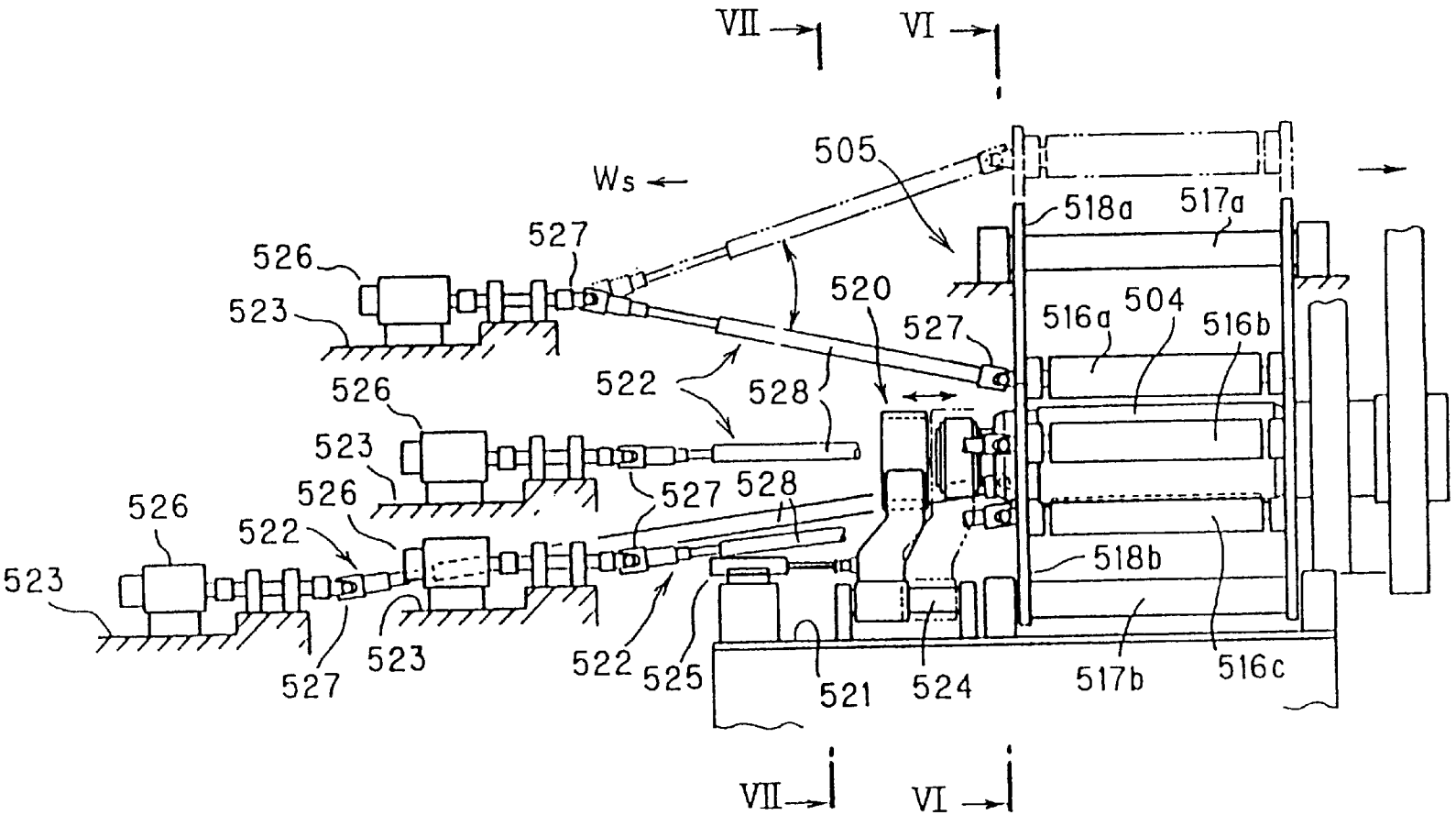
FIG. 31 is a front view of a band plate winding system showing a fifteenth embodiment of the present invention.
Figure 32:
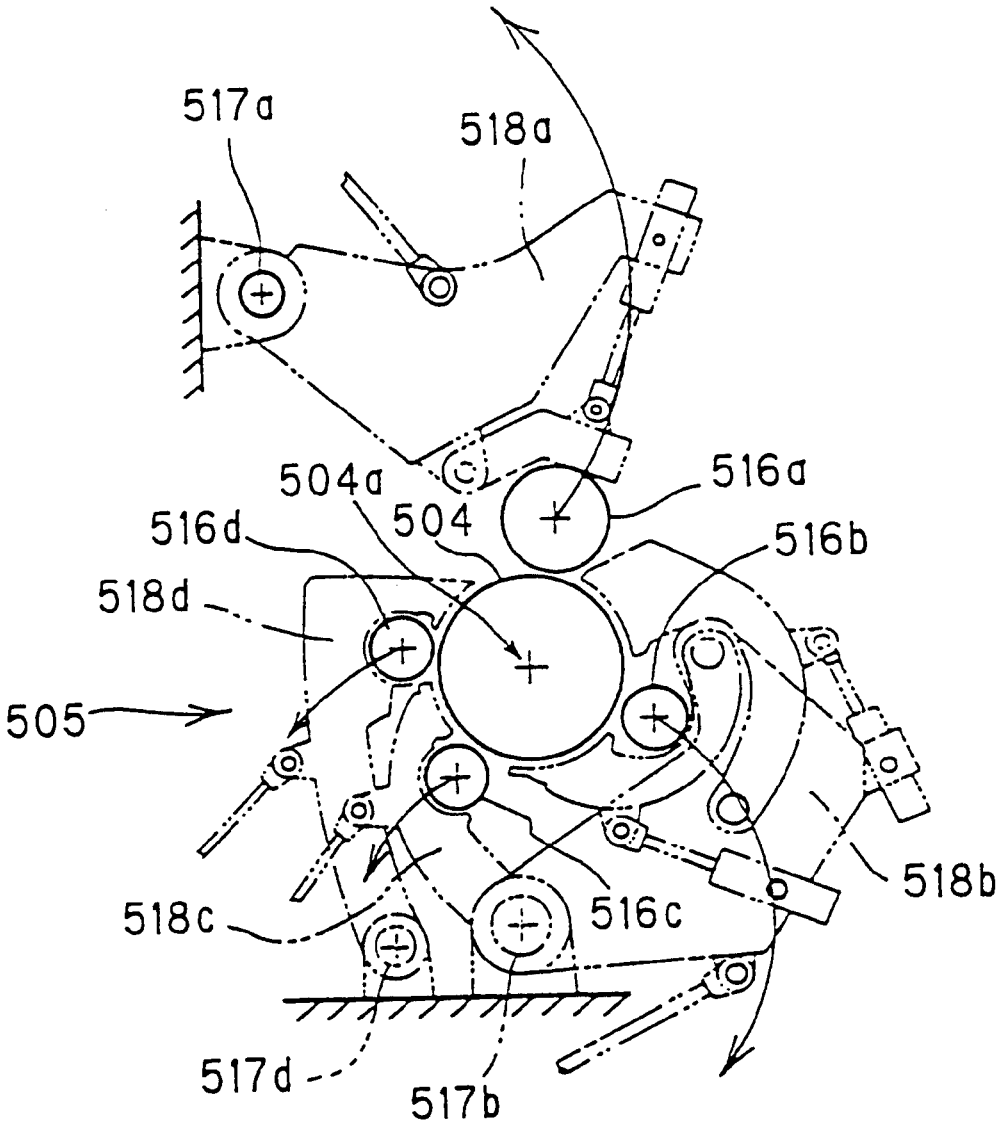
FIG. 32 is a side view taken on line VI—VI of FIG. 31.
Figure 33:
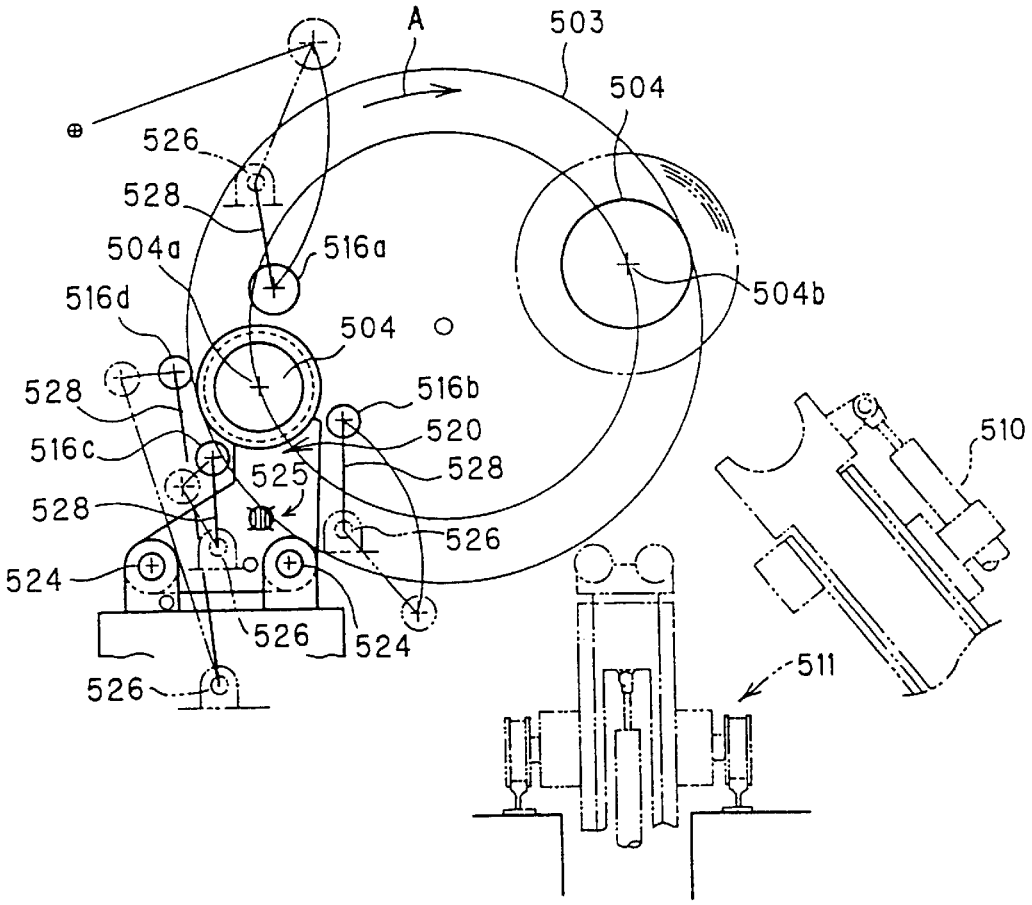
FIG. 33 is a side view taken on line VII—VII of FIG. 31.

FIG. 31 is a front view of a band plate winding system showing a fifteenth embodiment of the present invention. FIG. 32 is a side view taken on line VI—VI of FIG. 31. FIG. 33 is a side view taken on line VII—VII of FIG. 31.

As shown in FIG. 32, a wrapping device 505 at a winding start position 504*a* is provided with four unit rolls 516*a*, 516*b*, 516*c*, 516*d*. The unit roll 516*a* on an upper side has both ends supported on a frame 518*a* turning upward about a support shaft 517*a*. The unit rolls 516*b*, 516*c*, 516*d* on a lower side each have both ends supported on frames 518*b*, 518*c* and 518*d* turning downward about support shafts 517*b* and 517*d*.

As shown in FIG. 31, a detachable mandrel front end support device 520 is provided on a support base 521 on a work side $W_s$ of the wrapping device 505. The mandrel front end support device 520 has a contour formed in a rail sectional shape. Each unit roll driving system 522 is placed along a side portion of the mandrel front end support device 520, and is placed between the shaft ends of the unit rolls 516*a* to 516*d* and each support base 523 apart on the work side.

As shown in FIGS. 31 and 33, the mandrel front end support device 520 is supported on two track elements 524 provided parallel in a mandrel shaft direction on the support base 521, and is connected to a horizontal driving cylinder 525 provided on the support base 521. Upon driving of the cylinder 525, the mandrel front end support device 520 is moved in a switching manner to a mounting position or a dismounting position in an axial direction of a mandrel 504. The mandrel front end support device 520 has a lower portion spreading over and spanning the two track elements 524. A portion of the mandrel front end support device 520 passing between the unit rolls 516*b* and 516*c* forms a waist portion with a narrow width, and extends upward. An upper portion of the mandrel front end support device 520 forms a transverse cylindrical mandrel front end receiving portion. The entire contour of the mandrel front end support device 520 is in the shape of a rail section.

Each driving system 522 for the unit roll is composed of a motor 526 placed on the support base 523 apart on the work side, and an extendable transmission shaft 528 connected between an output shaft end of the motor 526 and a shaft end of the unit roll via universal joints 527.

FIG. 33 shows an arrangement relationship of the mandrel front end support device 520 and the unit roll driving systems 522 as viewed sideways. The four driving motors 526 are arranged at positions near the axes of the support shafts 517*a*, 517*b* and 517*d* for the unit rolls. The transmission shafts 528 and the four unit rolls 516*a*, 516*b*, 516*c*, 516*d* connected to the driving motors 526 are each arranged in such a manner as to keep a clearance from the upper portion and the waist portion of the mandrel front end support device 520.

At a winding completion position 504*b*, a mandrel front end support device 510, and a carrier trolley 511 for coil extraction are provided. The other constitutions are the same as in the first embodiment, and a detailed explanation therefor is omitted by reference to the first embodiment.

The action of the wrapping device 505 of the above-described constitution will now be described. The mandrel front end support device 520 is moved, by extension and contraction of the driving cylinder 525, to a position shown by a solid line and a position shown by a chain line in FIG. 31. Upon contraction of the driving cylinder 525, the mandrel front end support device 520 moves to the solid line position apart from the front end of the mandrel 504, and enters a wait state. In accordance with the contraction of the cylinder, the unit rolls 516*a*, 516*b*, 516*c*, 516*d* are each moved backward in a direction of an arrow to a position apart from the mandrel 504, and put on standby. In this state, a circular support frame 503 is turned, whereby the mandrel 504 can be freely made to make a revolving movement between the winding start position 504*a* and the winding completion position 504*b*.

With an empty mandrel 504 being moved to and stopped at the winding start position 504*a*, the unit rolls 516*a*, 516*b*, 516*c*, 516*d* are sent to face a peripheral surface of the empty mandrel 504. Upon extension of the driving cylinder 525, the mandrel front end support device 520 is brought to the chain line position to support the front end of the mandrel, completing preparations for winding of a band plate. At this time, the unit rolls 516*a*, 516*b*, 516*c*, 516*d* and the transmission shafts 528 remain spaced from the mandrel front end support device 520, and can move between the solid line position and the chain line position, without touching the mandrel front end support device 520.

In this state, the mandrel 504 and the unit rolls 516*a*, 516*b*, 516*c*, 516*d* are rotationally driven, and a band plate is fed from the rolling line to a space between the unit rolls 516*a*, 516*b* and the mandrel 504, whereupon the band plate is wrapped about the mandrel 504. During rotation of the unit rolls 516*a*, 516*b*, 516*c*, 516*d*, the transmission shafts 528 rotate while keeping spaced from the mandrel front end support device 520. Thus, the interference of the unit roll driving system 522 with the mandrel front end support device 520 is resolved.

At the start of winding of the band plate, both ends of the mandrel 504 are supported. Thus, warpage of the front end of the mandrel 504 due to impact by the incoming band plate at the start of winding is resolved, and deviated winding of the band plate in the axial direction is also eliminated.

After wrapping of the band plate around the mandrel 504 is confirmed, the mandrel front end support device 520 is moved backward to the solid line position upon contraction of the driving cylinder 525. Also, the unit rolls 516*a*, 516*b*, 516*c*, 516*d* are withdrawn to retracted positions. In this state, the mandrel 504 at the winding start position 504*a* continues to wind the band plate, and is moved revolvingly to the winding completion position 504*b* in accordance with the turning of the circular support frame 503. Synchronously with this movement, the empty mandrel 504 that has a coil taken out at the winding completion position 504*b* is moved to the winding start position 504*a*.

At the winding start position 504*a*, the mandrel front end support device 520 is brought to a position at which it supports the front end of the empty mandrel 504. Also, the unit rolls 516*a*, 516*b*, 516*c*, 516*d* are each brought to a position opposed to the mandrel 504 to be ready for next winding of the band plate. At the winding completion position 504*b*, the front end of the mandrel 504 is supported by the front end support device 510 to perform winding of the band plate. At completion of winding, a front end of the band plate cut on the rolling line is supplied to the empty mandrel 504 on standby. In this manner, wrapping of a next band plate is repeated, and extraction of a coil that has been wound at the winding completion position 504*b* is repeated.

According to the foregoing band plate winding system, even when the unit roll driving systems 522 of the wrapping device 505 are provided on the work side of the rolling line, the mandrel front end support device 520 can be safely placed at the winding start position 504*a* without its interference with the unit roll driving system. Thus, a failure in winding of a band plate by the winder can be resolved.

[Sixteenth Embodiment]

Figure 34:
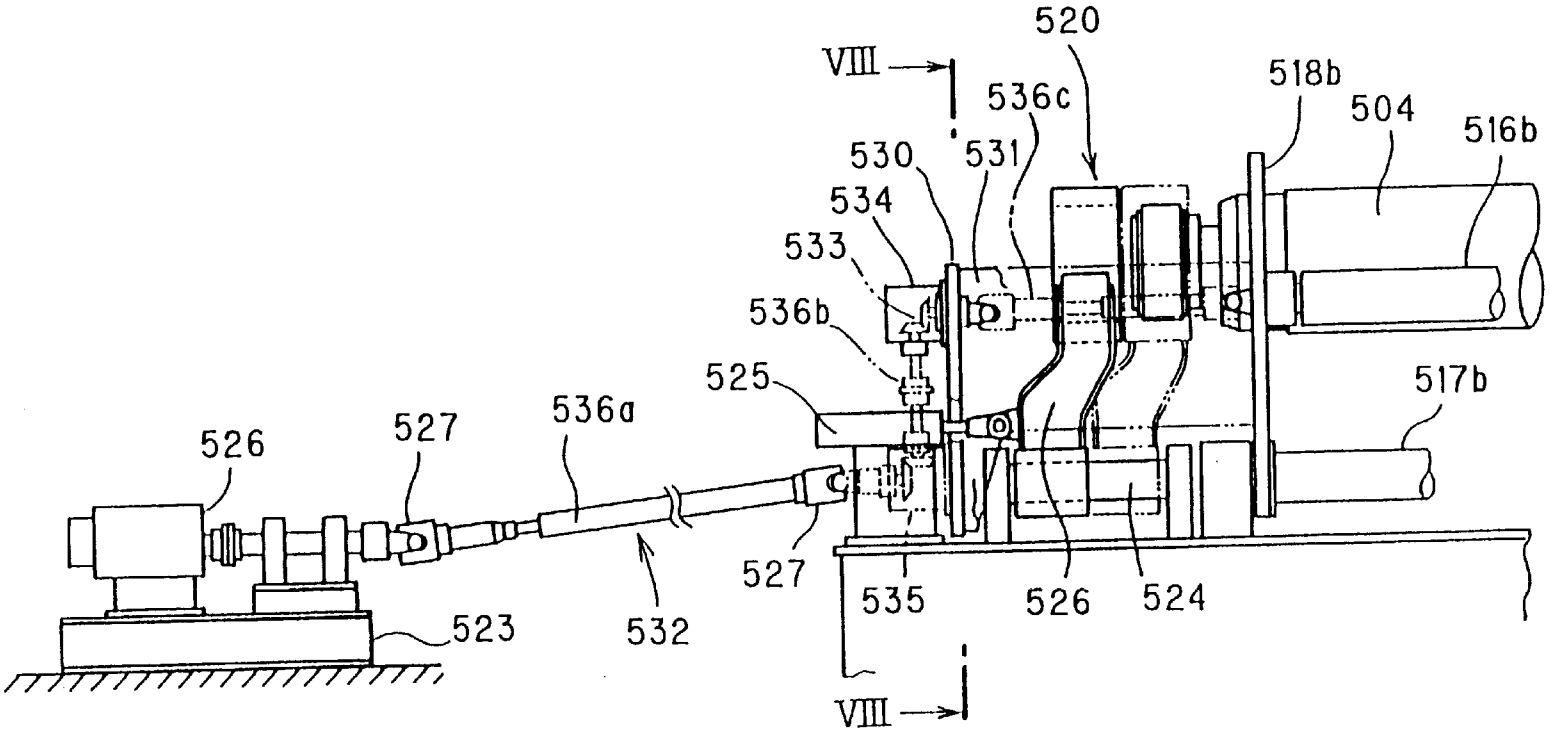
FIG. 34 is a front view of a band plate winding system showing a sixteenth embodiment of the present invention.
Figure 35:
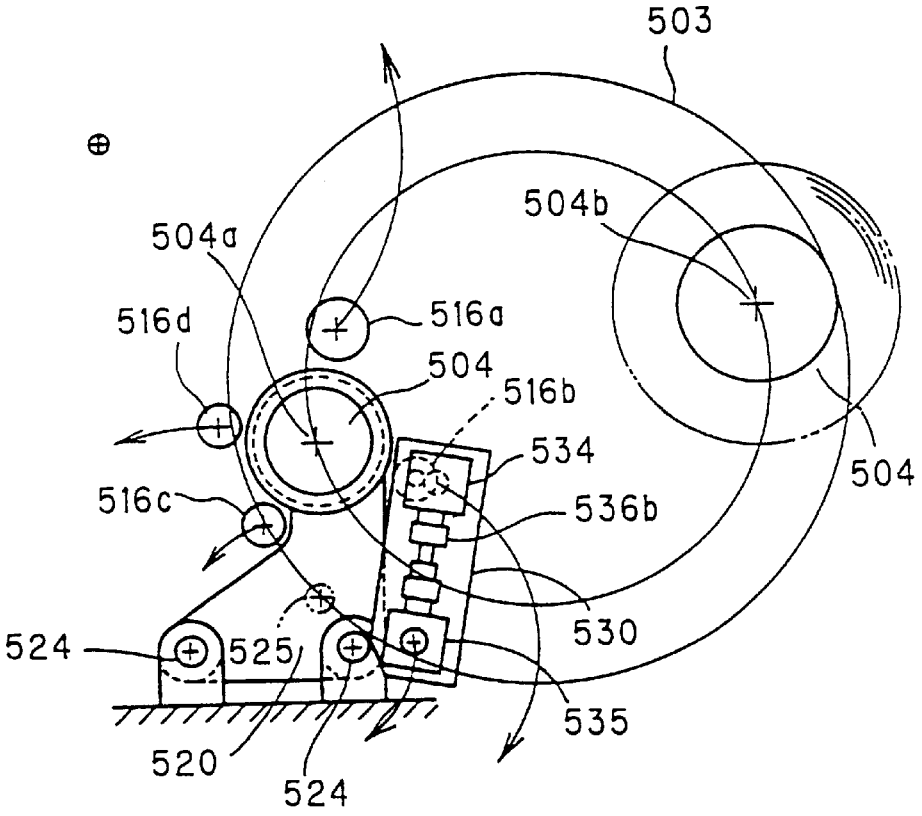
FIG. 35 is a side view taken on line VIII—VIII of FIG. 34.

FIG. 34 is a front view of a band plate winding system showing a sixteenth embodiment of the present invention. FIG. 35 is a side view taken on line VIII—VIII of FIG. 34.

To a work-side pivoting frame 518*b* for supporting the unit roll 516*b* in the previous embodiment, a parallel partition wall 530 is integrally joined, with spacing, by a joining plate 531, as shown in FIGS. 34 and 35. A mandrel front end support device 520 is provided on a support base in a spacing portion between the pivoting frame 518*b* and the partition wall 530.

The reference numeral 532 denotes a driving system for the unit roll 516*b*, the driving system being constituted to have the partition wall 530 as an intermediate support point. The unit roll driving system 532 comprises upper and lower connecting boxes 534, 535 each containing a bevel gear 533 and fixed to an outer surface of the partition wall 530; a transmission shaft 536*c* connected between the upper connecting box 534 and the unit roll 516*b* via universal joints 527 and nearly parallel to an axis of a mandrel; a transmission shaft 536*b* connected between the upper and lower connecting boxes 534 and 535; and a transmission shaft 536*a* for connecting the lower connecting box 535 to a driving motor 526. The shaft between the upper and lower connecting boxes 534 and 535 may be replaced by multi-stage transmission gears.

In FIGS. 34 and 35, only the driving system 532 for the unit roll 516*b* is shown, but the other unit rolls 516*a*, 516*c* and 516*d* can also be constituted in the same fashion.

With the above-described band plate winding system, a driving force of the driving motor 526 rotationally drives the unit roll via the transmission shafts 536*a*, 536*b* and 536*c*. At this time, the transmission shaft 536*c* is nearly parallel to the mandrel axis, or the upper connecting box 534 is situated slightly externally. This configuration makes it easy to retain the spacing between the transmission shaft 536*c* and the mandrel front end support device 520 at the time of driving of the driving system 532 and during turning of the unit roll 516*b* for retraction. Furthermore, the lower connecting box 535 can be placed near the unit roll 516*b* and a support shaft 517*b* for the support frame 518*b*. Thus, the angle of inclination of the transmission shaft 536*a* for advancing and retracting the unit roll becomes small. Consequently, the driving motor 526 can be located at a near position, and the driving system 532 can be constructed in a small size.

The present invention is not restricted to the above embodiments, and needless to say, various changes and modifications, such as those in the shapes and dimensions of the various members, can be made without departing from the gist of the invention.

Industrial Applicability

As described above, the band plate winding system of the present invention comprises a carrousel type winder having a plurality of individually driven mandrels on a circular support frame provided so as to be rotationally drivable in a vertical plane; and a roll type wrapping device for supporting a plurality of unit rolls provided so as to be movable forward and backward between a position surrounding the mandrel located at a winding start position of the winder and a retreat position. Thus, a band plate can be wound under high speed rolling to a degree comparable to that using a down coiler. Also, the scale of equipment, the size of an installation space, and the cost of equipment can be markedly decreased because of the concomitant use of the carrousel type winder. Hence, this band plate winding system is preferred for use in hot rolling equipment.

What is claimed is:

1. A band plate winding system comprising:

a carrousel winder having a plurality of individually driven mandrels on a circular support frame, said circular support frame being rotationally drivable in a vertical plane;

a roll wrapping device for supporting a plurality of unit rolls each provided so as to be movable forward and backward between a position surrounding the mandrel located at a winding start position of a winder and a position that does not surround the mandrel, a pressure plate located adjacent to each one of the unit rolls, the pressure plate and each one of the unit rolls are spaced apart along different portions of the circumference of the mandrel, the pressure plate applies pressure directly to the mandrel by direct physical contact, wherein a unit roll driving device for rotationally driving each of the plurality of unit rolls comprises transmission means which transmits a rotational force of a driving motor in a direction nearly perpendicular to an axis of the unit roll and which pivots integrally with a frame for supporting the unit roll;

one connector portion of the transmission means is connected by a transmission shaft to an end of the unit roll opposed to the one connector portion; and the driving motor is connected to another connector portion of the transmission means.

2. The band plate winding system of claim 1 wherein the unit roll driving device for rotationally driving each of the plurality of unit rolls comprises:

a parallel plate provided, outside and apart from the frame for supporting the unit roll, so as to turn integrally with the frame;

at least two bevel gear boxes provided on the parallel plate;

a transmission shaft for connecting these bevel gear boxes together;

a second transmission shaft for connecting one of the bevel gear boxes to the end of the unit roll opposed to the one bevel gear box; and a third transmission shaft for connecting another bevel gear box to the driving motor via universal joints.

3. The band plate winding system of claim 2, wherein a pair of bevel gears in a bevel gear box have a speed increasing gear ratio.

4. The band plate winding system of claim 1 wherein the unit roll driving device for rotationally driving the plurality of unit rolls comprises:

a gear support panel provided, outside and apart from the frame for supporting the unit rolls, so as to pivot integrally with the frame;

multi-stage gears placed at a pivot center position on the gear support panel, at positions on nearly the same axes as the unit rolls, and between both of these positions, and mounted and supported on the gear support panel so as to mesh with each other;

the driving motor is connected to a shaft of a gear placed at the pivot center position among the multi-stage gears, thereby rotationally driving this gear; and transmission shafts for connecting shafts of the gears, placed at the positions on nearly the same axes as the unit rolls among the multi-stage gears, to ends of the unit rolls corresponding to the shafts of the gears.

5. The band plate winding system of claim 1 wherein a deflector device for guiding a band plate to the winder comprises:

an upper deflector roll disposed above a pass line of the band plate upstream of the winder; and upper guide means which is disposed forwardly and backwardly movably so as to be located above the pass line of the band plate between the winder and the upper deflector roll, and which has a lower surface whose upper deflector roll side can be positioned above a horizontal line in contact with a lower portion of the upper deflector roll, said lower surface of the upper guide means being an inclined surface sloping downward toward the winder.

6. The band plate winding system of claim 5, further comprising an auxiliary deflector roll which is disposed so as to be movable forward and backward integrally with the upper guide means, and which increases an angle of deflection of the band plate from the upper deflector roll.

7. The band plate winding system of claim 1, wherein the roll wrapping device for supporting the plurality of unit rolls is structured, so that of the plural unit rolls provided so as to be movable toward and away from the mandrel, a unit roll located above the mandrel is supported by an upper frame which moves toward and away from the mandrel from above the mandrel, while another unit roll is supported by a lower frame which moves toward and away from the mandrel from below a pass line of the band plate.

8. The band plate winding system of claim 7, wherein first guide means for guiding a front end of the band plate to a wrapping entrance of the mandrel is provided on the upper frame.

9. The band plate winding system of claim 8, wherein second guide means facing the pass line of the band plate from above is provided pivotably between a rolling equipment side and the first guide means.

10. The band plate winding system of claim 7, further comprising interlocking means for moving wrapping guide means backward in association with a backward movement of the unit roll supported by the lower frame, said wrapping guide means being provided, on a front end side of the lower frame opposed to a front end of the upper frame, so as to be movable toward and away from the mandrel.

11. The band plate winding system of claim 7, wherein the unit roll supported by the upper frame is larger in diameter than the unit roll supported by the lower frame.

12. The band plate winding system of claim 1, wherein the roll wrapping device for supporting the plurality of unit rolls is structured so that a small cylinder for backup of a unit roll supported on a large frame via a panel arm among the plurality of unit rolls provided so as to be movable toward and away from a circumferential surface of the mandrel located at the winding start position has a built-in pressure oil chamber containing an amount of pressure oil enough to absorb and cushion maximum impact force which the unit roll undergoes.

13. The band plate winding system of claim 12, wherein the small cylinder for backup of the unit roll comprises:

an oil chamber for piston stroke having a rod side connected to the panel arm and a cylinder side connected to a large frame side, and having a required length for extending and contracting a piston rod; and an oil chamber for impact force cushioning provided to communicate with a head side of the oil chamber for piston stroke.

14. The band plate winding system of claim 13, wherein the oil chamber for piston stroke and the oil chamber for impact force cushioning are connected together via an intermediate cover portion, and communicate with each other through a flow path inside the intermediate cover portion.

15. The hand plate winding system of claim 1 wherein the roll wrapping device for supporting the plurality of unit rolls comprises two unit roll support frames provided so as to derrick and pivot from an upstream side of a rolling equipment line about lower support shafts as centers of rotation until facing the mandrel at a wrapping start position, said two unit roll support frames being each in the form of a frame individually movable between a set mandrel facing position and a set retreat position without interference by each other.

16. The band plate winding system of claim 15, wherein of the two unit roll support frames, the support frame for the upper unit roll is placed externally, while the support frame for the lower unit roll is placed internally, and a shape of the external support frame and a shape of the internal support frame are combined such that the internal support frame is movable to the retreat position when the external support frame has been brought to a band plate wrapping position at which the external support frame faces the mandrel.

17. The band plate winding system of claim 15, wherein of the two unit roll support frames, at least an internally placed support frame for a lower unit roll is mounted detachably on the support shaft by a semi-arcuate divided boss portion.

18. The band plate winding system of claim 1, wherein the roll wrapping device for supporting the plurality of unit rolls supports the unit rolls on a plurality of pivoting frames which pivot so as to be moveable toward and away from a circumferential surface of the mandrel located at the winding start position;

a first panel arm and a second panel arm are pivotably provided on at least one of the plurality of pivoting frames, said first panel arm having a band plate wrapping guide at a front end thereof, and said second panel arm having a second band plate wrapping guide at a front end thereof and being provided with a unit roll; and a pivot shaft of the second panel arm is placed in a plane of lateral projection of the first panel arm at the winding start position.

19. The band plate winding system of claim 1, wherein a driving shaft for each of the unit rolls is provided on a work side of a rolling equipment line; and a detachable mandrel front end support device is provided opposite a front end of the mandrel located at the winding start position, said mandrel front end support device having a sectional shape passing between the unit rolls facing a circumferential surface of the mandrel at the winding start position, and between unit roll driving systems, and said mandrel front end support device being movable parallel to an axis of the mandrel.

20. The band plate winding system of claim 19, wherein the detachable mandrel front end support device is adapted to be movably engaged on track elements fixedly placed on a support base in parallel with the axis of the mandrel, and to be moved to a position, at which the detachable mandrel front end support device is attached to or detached from the front end of the mandrel, by driving means placed on the support base.

21. The band plate winding system of claim 19, wherein a parallel partition wall is provided, with the mandrel front end support device being sandwiched between the partition wall and a support frame for a unit roll, and pivots integrally with, but apart from, the support frame; and the unit roll driving systems are provided, with the partition wall serving as an intermediate support point.

22. A bend plate winding system comprising:

a carrousel winder having a plurality of individually driven mandrels on a circular support frame, said circular support frame being rotationally drivable in a vertical plane;

a roll wrapping device for supporting a plurality of unit rolls each provided so as to be movable forward and backward between a position surrounding the mandrel located at a winding start position of a winder and a position that does not surround the mandrel, a pressure plate located adjacent to each one of the unit rolls, the pressure plate and each one of the unit rolls are spaced apart along different portions of the circumference of the mandrel, are effective to apply direct pressure to the mandrel, wherein each unit roll and each pressure plate have a face facing the mandrel and the distance between the center of the mandrel and each of the faces is equal.

* * * * *